US008011148B2

(12) United States Patent
Bertke et al.

(10) Patent No.: US 8,011,148 B2
(45) Date of Patent: Sep. 6, 2011

(54) MODULAR, PORTABLE, INTERLOCKING DECKING SYSTEM

(75) Inventors: Patrick J. Bertke, Dayton, OH (US); John M. Van Leeuwen, Dayton, OH (US); Michael P. Weaver, Dayton, OH (US)

(73) Assignee: We Design Partners, LLC, Dayton, OH (US)

( * ) Notice: Subject to any disclaimer, the term of this patent is extended or adjusted under 35 U.S.C. 154(b) by 282 days.

(21) Appl. No.: 12/485,729

(22) Filed: Jun. 16, 2009

(65) Prior Publication Data

US 2010/0257796 A1 Oct. 14, 2010

Related U.S. Application Data

(60) Provisional application No. 61/132,214, filed on Jun. 18, 2008.

(51) Int. Cl.
*E04B 1/32* (2006.01)

(52) U.S. Cl. ..... 52/263; 52/299; 52/274; 52/480; 52/283; 52/284; 52/282.3; 52/282.1; 52/79.5; 52/747.1

(58) Field of Classification Search ..... 52/299, 52/263, 274, 480, 283, 284, 282.3, 282.1, 52/79.5, 745.05, 745.13, 747.1
See application file for complete search history.

(56) References Cited

U.S. PATENT DOCUMENTS

| | | | | |
|---|---|---|---|---|
| 4,074,488 | A | 2/1978 | Ray, III | |
| 4,622,792 | A | 11/1986 | Betts | |
| 4,691,484 | A | 9/1987 | Wilson | |
| 4,996,804 | A | 3/1991 | Naka et al. | |
| 5,163,967 | A | 11/1992 | Hoffman et al. | |
| 5,412,914 | A | 5/1995 | Daw et al. | |
| 5,758,467 | A | 6/1998 | Snear et al. | |
| 5,791,096 | A * | 8/1998 | Chen | 52/126.6 |
| 5,848,501 | A | 12/1998 | Taipale et al. | |
| 5,953,870 | A | 9/1999 | Jette | |
| 6,061,991 | A | 5/2000 | Dahl | |
| 6,128,880 | A | 10/2000 | Meenan, Jr. | |
| 6,209,267 | B1 * | 4/2001 | Dantzer | 52/79.6 |
| 6,219,981 | B1 * | 4/2001 | Bergelt | 52/294 |
| 6,519,902 | B1 * | 2/2003 | Scissom | 52/126.4 |
| 6,804,923 | B1 | 10/2004 | Potter | |
| RE39,097 | E | 5/2006 | Schilham | |
| 7,140,156 | B1 | 11/2006 | Lowe, Jr. et al. | |
| 7,360,343 | B1 * | 4/2008 | Spransy et al. | 52/263 |
| 7,454,869 | B2 | 11/2008 | Owen | |
| 7,698,860 | B2 | 4/2010 | Hockemeyer et al. | |
| 7,918,059 | B2 | 4/2011 | Repasky | |
| 2005/0076590 | A1 | 4/2005 | Wang et al. | |
| 2006/0265987 | A1 | 11/2006 | Iannone | |
| 2007/0193145 | A1 | 8/2007 | Wheatley | |

* cited by examiner

*Primary Examiner* — Brian Glessner
*Assistant Examiner* — Gisele Ford
(74) *Attorney, Agent, or Firm* — James R. Eley; Michael A. Forhan; Eley Law Firm Co. LPA

(57) ABSTRACT

Components for use in the assembly and installation of a modular decking system, comprised of structural free floating piers which distributes loads of deck pad to ground, piers have a pad bearing surface and four uniformly placed receiver blocks which interlock with corresponding recesses at four pad corners, an interlocking cam passes through pad recesses at deck surface and locks to piers by rotating cam with custom designed tool.
The system is designed to be assembled without permanent fasteners to allow for expansion, reconfiguration or relocation, or addition of traditional and contemporary deck accessories that engage and interlock with the piers, pads and cams. One ideal manufacturing method of one or any of the system components is compression molded post-consumer and/or industrial thermo-plastic waste.

18 Claims, 33 Drawing Sheets

MODULAR, PORTABLE, INTERLOCKING DECKING SYSTEM

This application claims priority to U.S. provisional patent application No. 61/132,214, filed Jun. 18, 2008.

FIELD

The present invention relates to decking, platform, walkway, and or stage systems which incorporate non-traditional construction methods, typically used in the assembly of traditional pressure treated decks, composite decks, cement or stone patio pavers and any surface constructed to enhance outdoor and/or indoor living needs and use. The present invention particularly is a modular, portable and interlocking decking system that is predominately and ideally comprised of 100% post-consumer and/or industrial thermo-plastic waste that can easily be assembled, disassembled, stored, or transported for relocation or reconfiguration.

BACKGROUND

It is common for homes and other structures to be enhanced with the addition of outdoor living spaces often constructed of wood, framed with either a wood or composite surface, poured in place concrete patios or brick pavers placed over a compacted aggregate base.

The first of the aforementioned construction methods, particularly wood, are subject to weather causing the structure to warp, splinter or rot. Maintenance is required to protect the structure from the elements and seal the surface from moisture. Variations in temperature and humidity cause them to expand and contract, which loosens the metal connection hardware. Commonly, installation requires a specialized skill set and is labor intensive requiring footings to be dug below the specified frost line. Additionally, pressure treated lumber is treated with chemicals exposing the installer to health risks. Lumber is also susceptible to deterioration by mildew, mold, and insects and is subject to staining. The deck is considered to be a fixed structure; therefore it cannot be relocated and only removable in a more-or-less destructive fashion.

Second, there are drawbacks to pour in place patios and various paver systems. Particularly, each method requires labor-intensive excavation and can become stained. Concrete pavers are subject to cracking due to settling.

Numerous designs of decking systems have been developed to address the issues associated with wood framed decks, concrete patios and pavers.

U.S. Pat. No. 5,848,501 is in reference to a modular portable stage and floor system using a small number of standardized modular components to construct a temporary platform. Modular and vertical supports can be detachably coupled together in a slidably interlocked manner using a universal connector mechanism in to a support frame structure for supporting a plurality of modular deck panels. By using a small number of supports and a universal connector mechanism that is similar for all structural interconnections required to build the support frame structure, the modular portable stage and floor system is strong and stable, yet easily transported, assembled and disassembled.

U.S. Pat. No. 4,691,484 is in reference to a portable deck system of any size and shape that can be packaged and shipped in a collapsible configuration in motor homes, trailers and the like for quick assembly.

U.S. Pat. No. 4,622,792 is in reference to a modular deck structure comprised of a plurality of rectangular flooring platforms.

U.S. Pat. No. 6,209,267 B1 is in reference to a modular decking system with finished planks for mounting on outside edges of the frames to finish the base of the deck, a railing assembly includes posts for mounting, and rectangular fence panels which are connected to the posts, mainly by sliding the panels into longitudinally extending grooves in the post.

U.S. Pat. No. 6,128,880 is in reference to a modular decking system that allows the user to install decking over areas containing buried services such as cables or piping. The system is readily removable by an owner in a non-destructive manner so that it can be easily reinstalled.

U.S. Pat. No. 6,804,923 B1 is in reference to a modular prefabricated deck system which includes a plurality of rectangular flooring modules. Each module may include a plurality of laminations, such as a decorative upper element, and a lower support element for supporting the module. Each module may include interlocking structure for engaging adjacent modules upon installation.

U.S. Pat. No. 7,140,156 is in reference to materials for use in installing a deck including a plurality of decking tiles, each of the tiles having an outside corner angle with a hole at a predetermined location with respect to the corner and a plurality of decking tile connectors. Fasteners upstanding in the quadrants at locations align with the holes in the tiles.

U.S. Pat. No. 5,163,967 is in reference to a concrete pier block having an upwardly opening recess forming an anchor seat for building elements. The recess opens out the side so that building elements can be laid horizontally therein.

U.S. Pat. No. 5,758,467 is in reference to a modular construction member for the construction of decking, flooring, roofing, and the like, including a mateable connector formed integrally with the construction member for connecting successive deck members to form a deck assembly.

U.S. Pat. No. 6,061,991 is in reference to a deck system that provides an easy to install deck by using unique columns, rails and planks. The rails enable quick assembly.

SUMMARY

It is an object of the present invention to provide a portable, modular and interlocking decking system that can be assembled and disassembled for reconfiguration, relocation and expansion. The general ease-of-use of the system and simple interlocking component design allows for the decking system to be installed in a matter of time that is significantly less than the installation of a traditional pressure treated lumber deck, composite material deck or other concrete/brick patio surface. The system is comprised of three standard components—Pad, Pier and Cam Lock—each of which interlocks together using a custom designed hand tool that is provided with the purchase of the system. The Pad serves as the deck's surface, the Piers support the Pads at each corner, and each Pad is secured in place by a Cam Lock that locks with Pier(s) below. The assembly process is intuitive; four piers will be set to support one pad. Once the pad is resting on the bearing plate of the support pier, the cam lock is then secured into place. The modularity of the system allows for a simple and easy assembly process, which allows for multiple configurations. The universal, interlocking design of the system allows for the addition of the following accessory components, consisting of, but not limited to, railings, storage bins, light fixtures, gazebos, planters, benches, tables and other accessories that will utilize the same surface pad corner recesses and cam lock system to engage and secure with a support pier.

The free-floating foundation is based on individual load bearing piers resting on grade or level surface and is considered a temporary structure, allowing the system to be utilized by more than just homeowners. Renters, condominium owners and secondary residences, such as cottages or trailers, will benefit from the interlocking and modular system, ideally being able to relocate, reconfigure, expand the system or store the system if desired.

The system components are designed to be easily packaged on and within the dimensions of standardized palettes traditionally used for shipping and storage purposes.

A support pier has four receiver blocks that support the surface pads and can, if desired, be secured to the ground via spikes that pass through a hole within the support pier base. A receiver block is a protrusion molded atop the pier, that accepts the cam lock, the locking mechanism that ultimately secures the system together. Each pier having four receiver blocks allows for engagement with the corner recess holes of one, two, three or four surface pads based on varying configurations. A cam lock passes through the surface pad recess at each corner to lock with the support pier by means of rotating it vertically 90 degrees in a clockwise fashion with detents providing tactile feedback and locking the cam once the turn is complete. The support piers are designed to maximize bearing support and distribute dead and/or live load weight to the ground.

A surface pad is designed to be easily and manually transported for easy and quick placement on the support piers. Once locked together via the cam lock engagement with support piers, the pads bear on load bearing plates within the support piers and are connected by means of the receiver blocks. Each pad has structural support webbing on its underside to distribute the live and dead load weights to the support piers. Each pad has drainage or weep holes passing through its top surface to shed and disperse water.

When a surface pad is resting on the bearing plate of a support pier and a receiver block is in the bottom surface pad recesses, a cam lock will be used to lock the system in place. When a cam lock is placed through the top surface pad corner recess, the hand tool is used to turn the cam lock 90 degrees in a clockwise fashion. The cam lock mechanism is designed to give the user tactile feedback once the cam lock is turned the full 90 degrees and locked in place.

Pier extension block rest atop and engages a structural pier as a means to keep deck surface level when installed on sloped grades.

Similarly, a step block rest atop and engages a structural pier as a means to elevate a portion, or portions of deck pads to create a multi-level surface within one assembly.

A perimeter skirting module utilizes the same method of attachment by means of a cam lock engaging a structural pier and designed to conceal support piers below deck surface.

A railing system may be added to the installed deck by means of a support block secured to a structural pier. A lateral brace is attached to the support block by means of sliding a molded "t" rail into and through the "t" rail slot within the support block and vertical post is then secured to lateral brace by means of similar "t" rail/"t" rail slot method of installation.

Currently developed and/or future accessories and their individual components will engage the piers and pads and utilize the same or similar method(s) of locking components or modules together with the use of a cam lock fastener.

BRIEF DESCRIPTION OF THE DRAWINGS

A fuller understanding of the nature and objects of the present invention will become apparent upon consideration of the following detailed description, taken in connection with the accompanying drawings, wherein.

DETAILED DESCRIPTION

Figure 1:
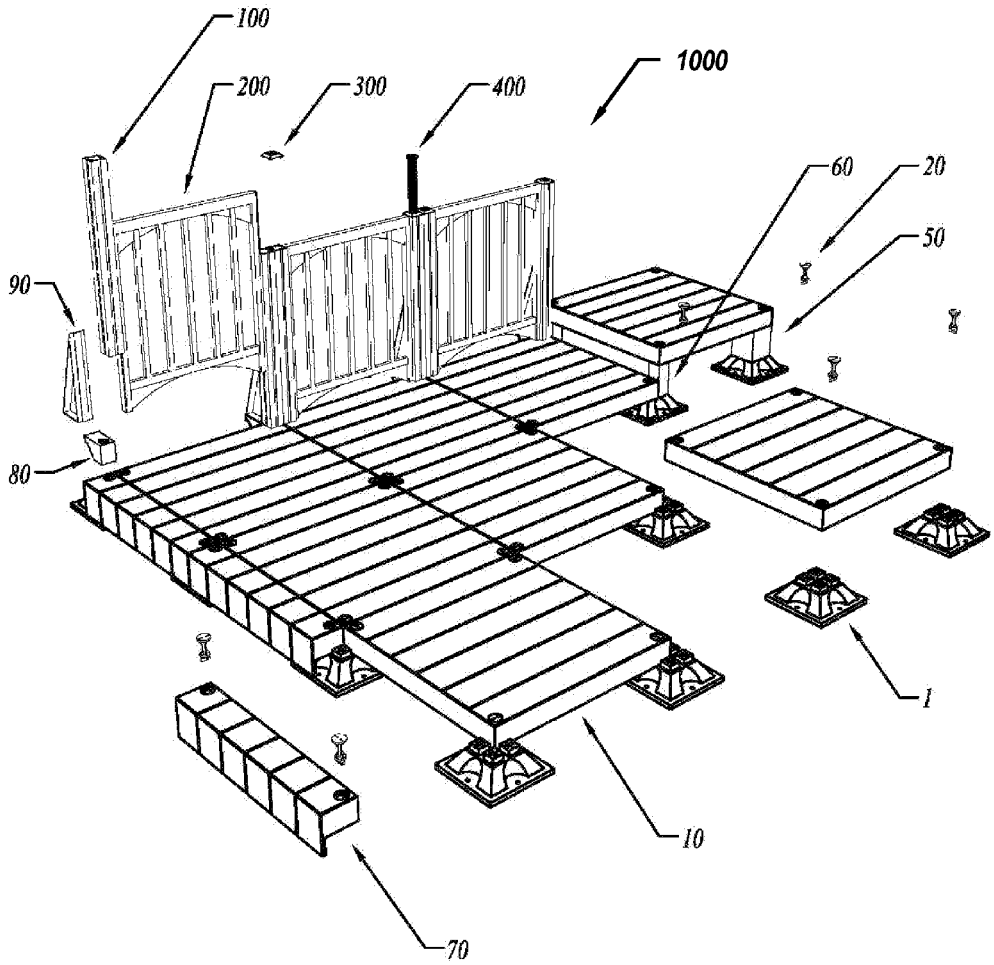
FIG. 1 is a perspective view of an overall system illustrating the interaction of modular components in a state of assembly and or disassembly.

Referring now to the drawings, in FIG. 1 there is shown a modular, interlocking decking system 1000 showing the basic assembly or disassembly of the core system components embodying the present invention. As hereinafter described, the decking system is modular, therefore expandable and reconfigurable and can be assembled and disassembled as desired.

FIG. 1 illustrates a perspective view of the basic assembly and or disassembly of the core system components. Load bearing deck surface pad 10 rests upon and is supported by structural pier 1 and cam lock fastener 20 passes through load bearing deck surface pad 10 and engages structural pier 1 rotated 90 degrees securing all components in place. Perimeter skirting 70 is attached to structural pier 1 and secured by means of cam lock fastener 20. Support block 80 rests upon structural pier 1 and is secured by means of cam lock fastener 20. Lateral support brace 90 engages with support block 80 by means of molded interlocking component on lateral support brace 90 through molded receiver element on support block 80.

Extruded vertical post 100 engages molded interlocking component on lateral support brace 90 and molded receiver element on extruded post 100. Railing module 200 engages extruded vertical post 100 by means of "T" member and "T" slot. Post cap 300 aligns with top opening of extruded vertical post 100 and is secured in place with extended cam lock fastener 400. Step block 60 rests upon structural pier 1 providing a bearing surface for surface pad 10. Load-bearing deck surface pad 10 is secured to step block 60 by means of a cam lock fastener 20. Similarly, pier extension block 50 receives load bearing deck surface pad 10 and is secured in place by cam lock fastener 20.

Figure 2:
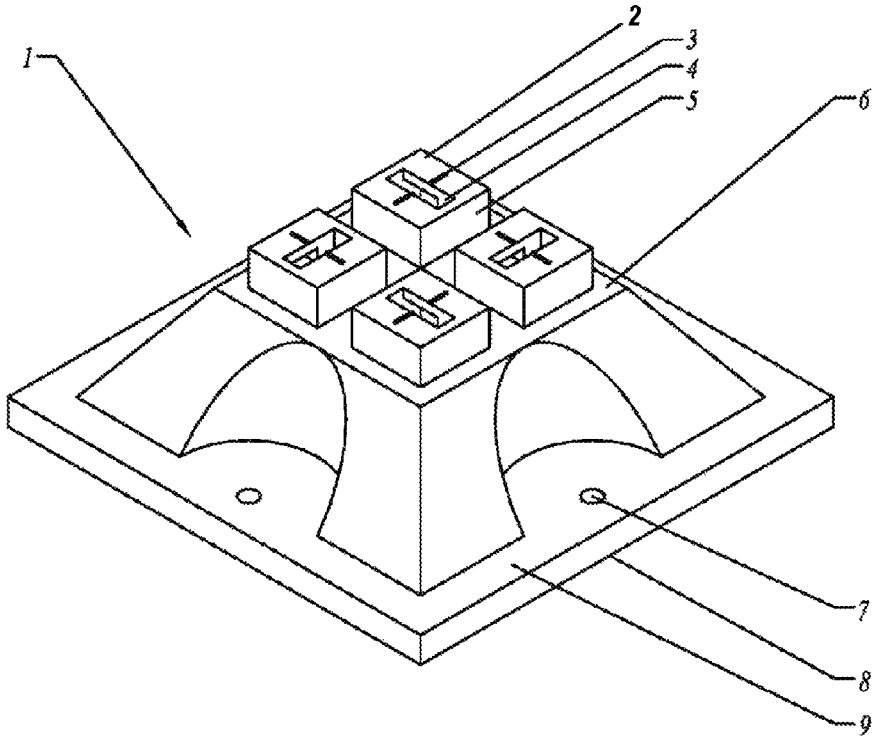
FIG. 2 is a top isometric view of a support pier according to an embodiment of the invention.
Figure 3:
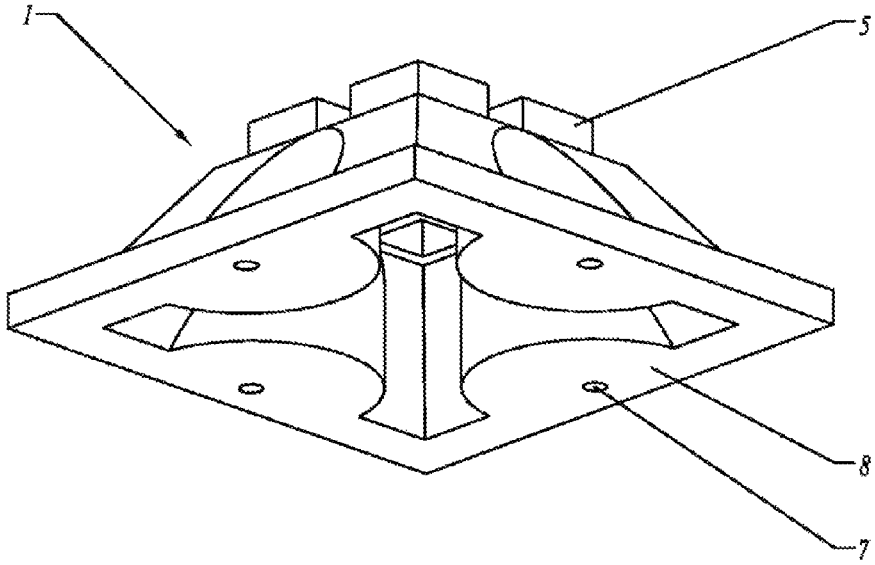
FIG. 3 is a bottom isometric view of a support pier according to an embodiment of the invention.
Figure 4:
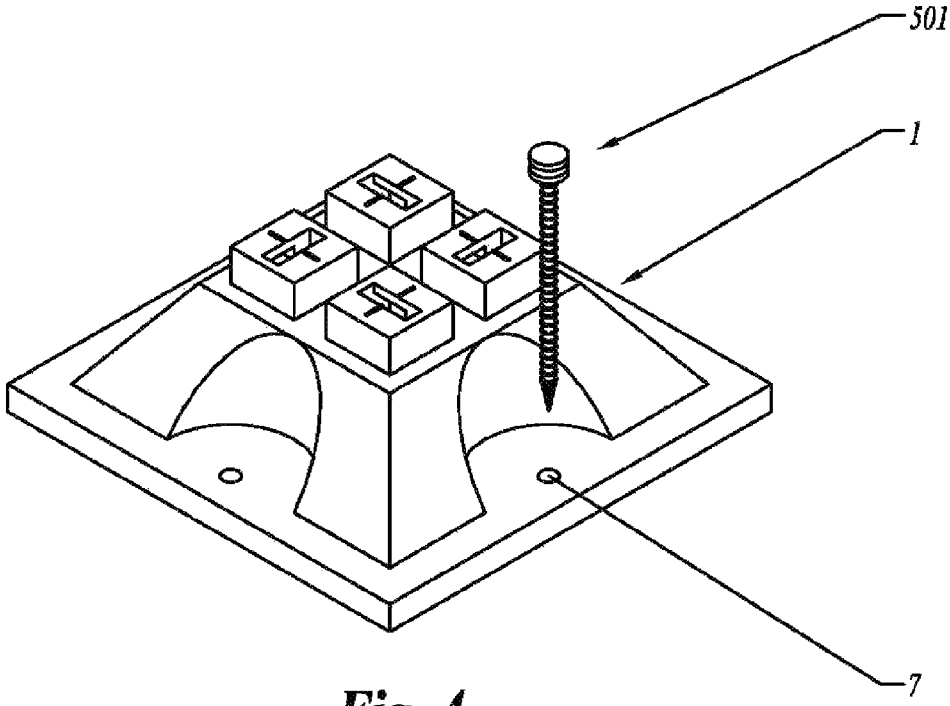
FIG. 4 is a top isometric view of a support pier illustrating a spike and through hole for securing the support pier to the ground, grade, or surface below.
Figure 5:
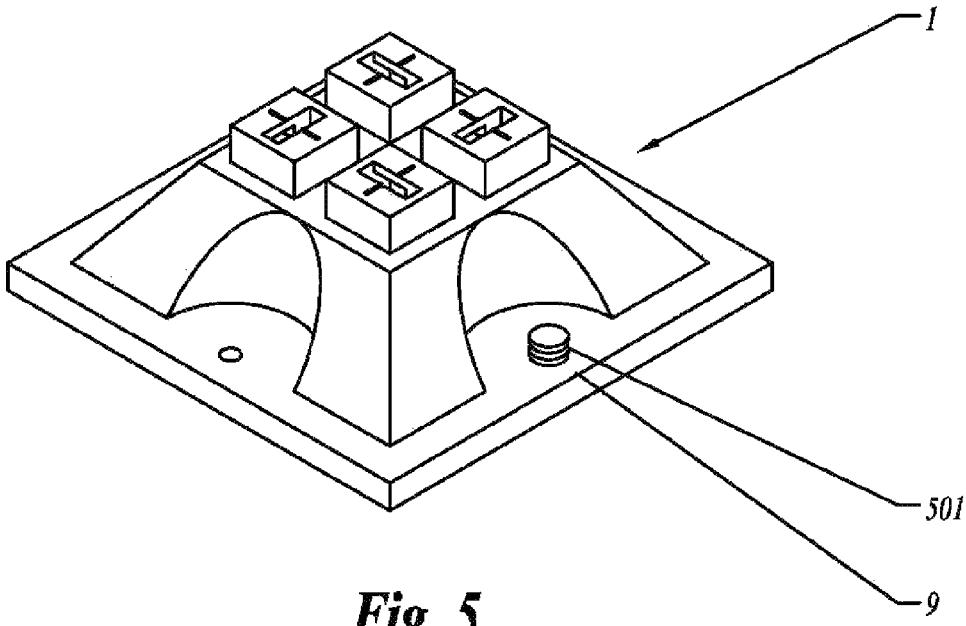
FIG. 5 is a top isometric view of a support pier secured to grade or surface below.
Figure 6:
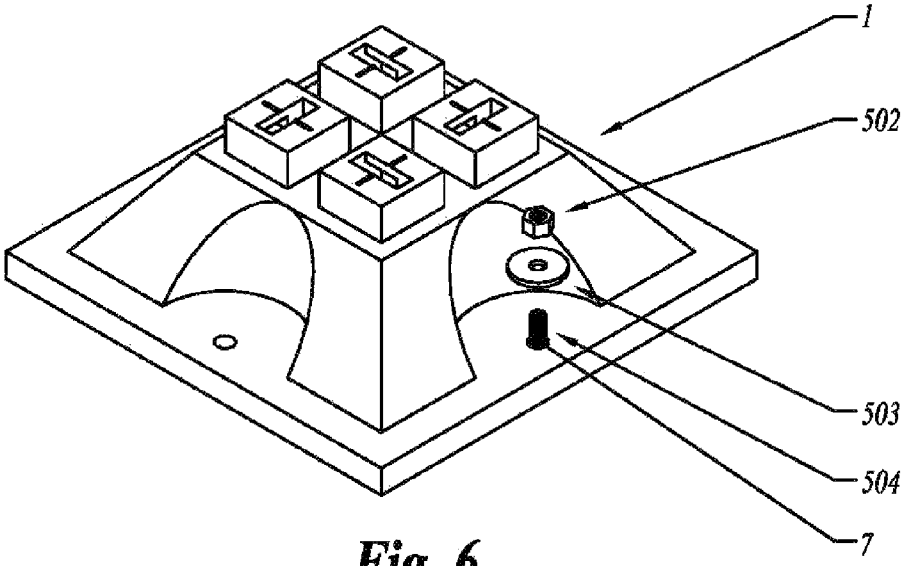
FIG. 6 is top isometric view of a support pier about to engage an anchor bolt secured within a fixed footer or foundation and securing hardware.
Figure 7:
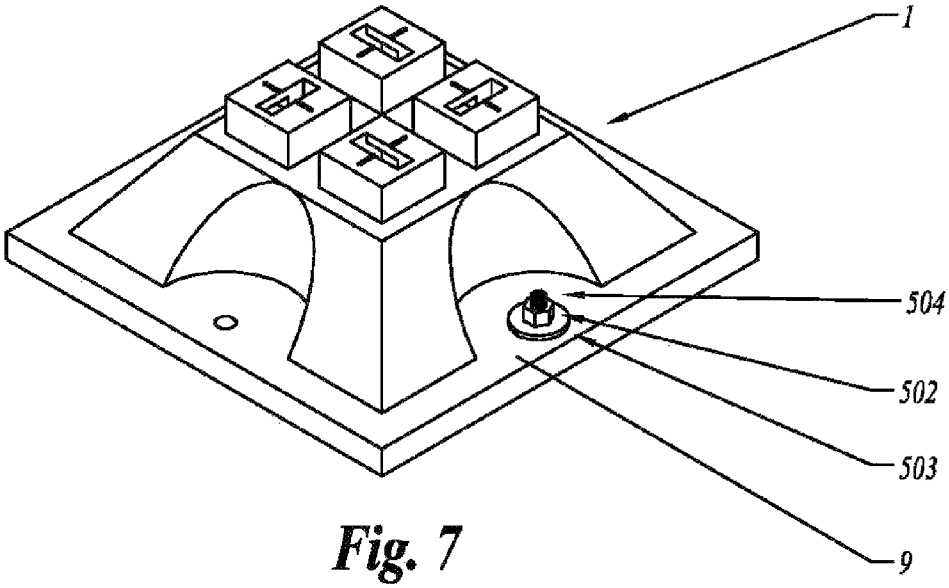
FIG. 7 is a top isometric view of a support pier showing a washer and nut securing the structural pier to the anchor bolt.

FIG. 2 illustrates structural pier 1 comprised of four uniformly placed receiver blocks 5 and molded into the receiver block top surface 5 to a male detent 3 and cam slot 4 and load bearing elevated surface plate 6. Structural support pier 1 can be secured to the grade or a substructure via through hole 7 on bearing plate 8 resting on grade shown in FIG. 3. Fastener 501 shown in FIG. 4 aligns with hole 7. FIG. 5 shows structural support pier 1 being anchored to the ground by means of fastener 501 passing through the hole 7 until it engages with top surface 9 of bearing plate. An anchor bolt 504 capped with optional washer 503 and secured by optional nut 502 shown in FIG. 6 secures fastener 501. When washer 503 makes contact with top surface 9 of bearing plate as shown in FIG. 7, structural pier 1 is secured to grade or below surface.

Figure 8:
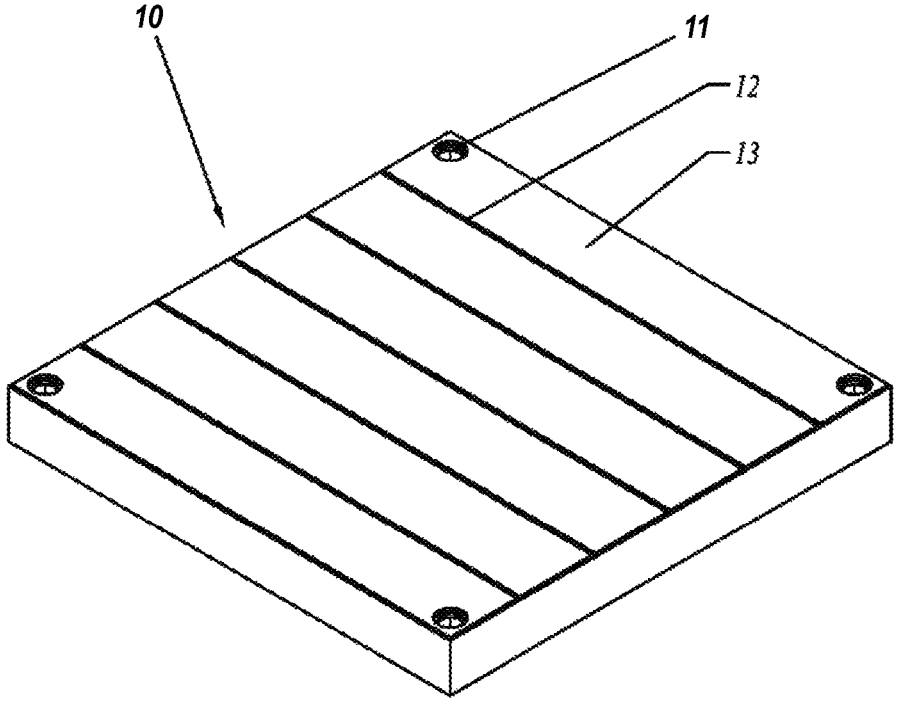
FIG. 8 is a top isometric view of a surface pad according to an embodiment of the invention.
Figure 9:
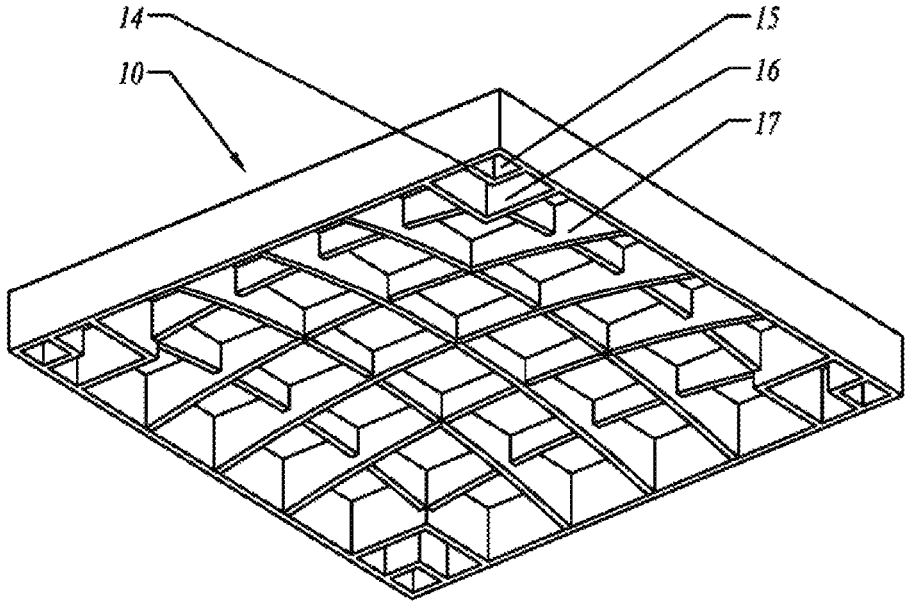
FIG. 9 is a bottom isometric view of a surface pad according to an embodiment of the invention.
Figure 10:
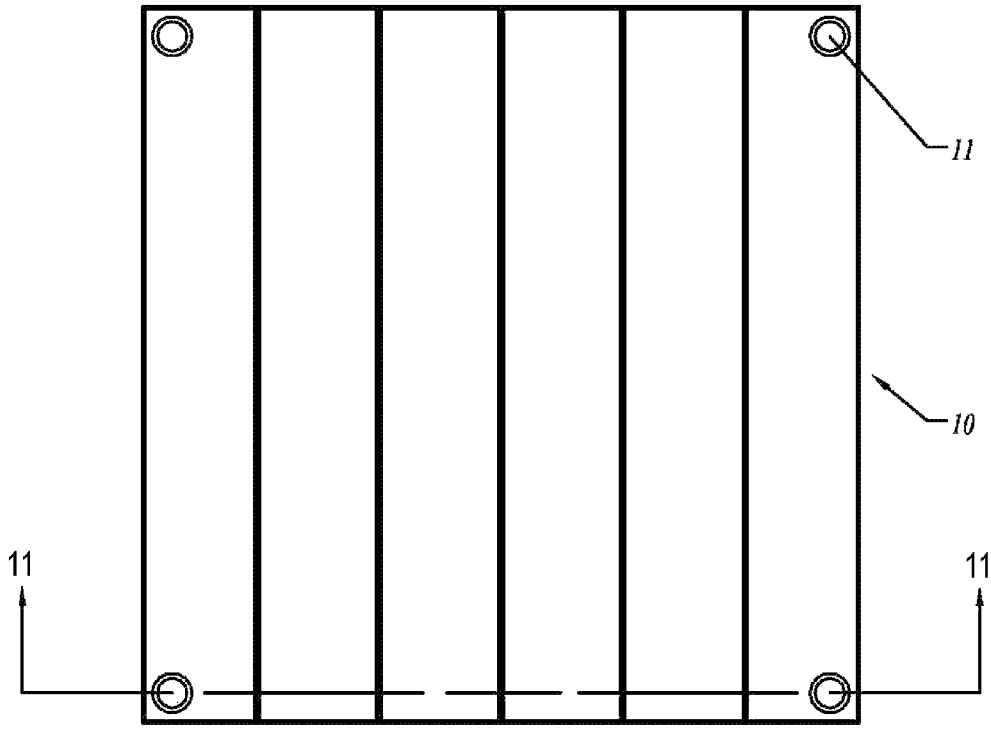
FIG. 10 is a top view of a surface pad.
Figure 11:
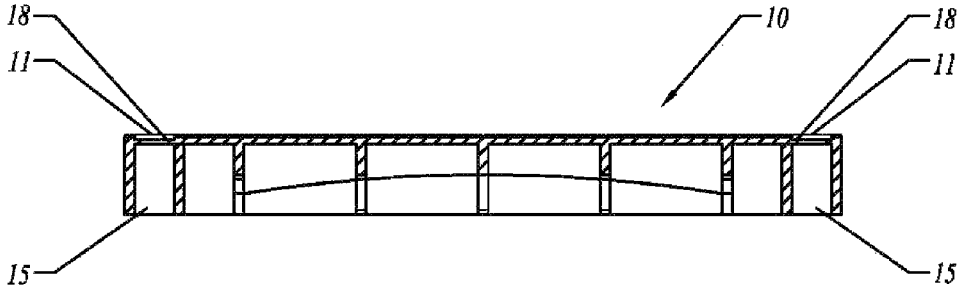
FIG. 11 is a section view of the surface pad of FIG. 10.

As shown in FIG. 8, surface pad 10 includes, at each corner, four uniformly placed through holes 11. Weep holes 12 provide for drainage of pad surface 13 to distribute water away from the system. Structural ribs 17 distribute dead and live surface loads. As shown in FIG. 9, receiver block receptacle 15 receives the receiver block 5 of structural pier 1. As shown in section in FIG. 11, molded shoulder 18 in through hole 11 on surface pad 10 to receive alignment collar 26.

Figure 12:
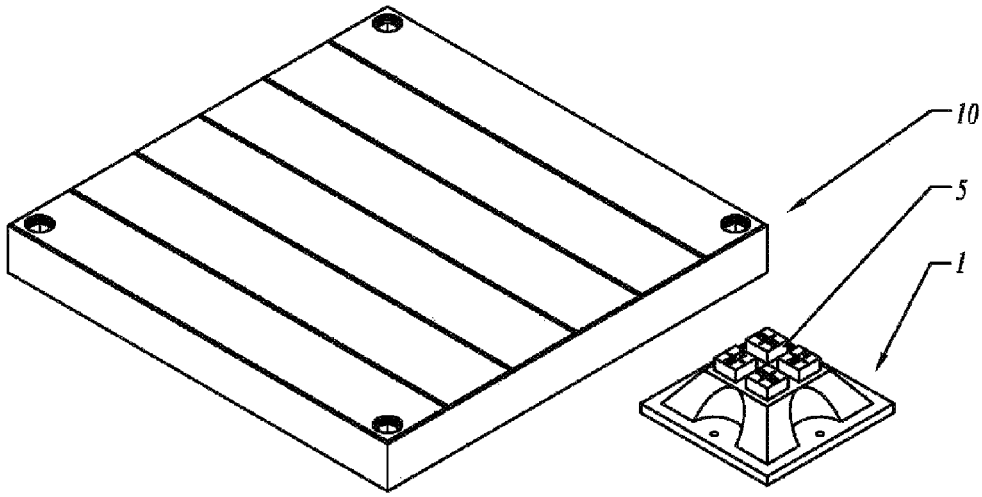
FIG. 12 is a top isometric view of a surface pad aligning with a structural pier.
Figure 13:
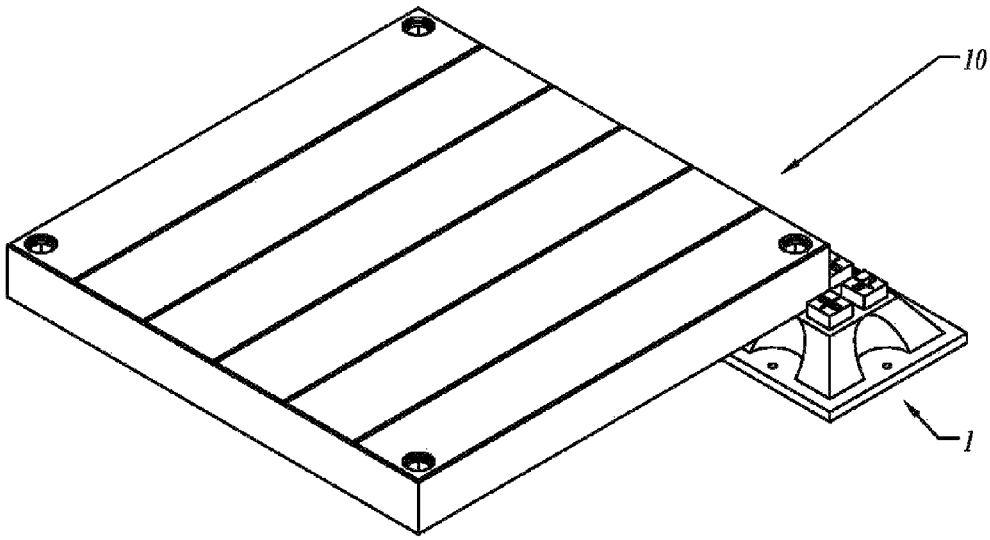
FIG. 13 is a top isometric view of a surface pad bottom recess fitting onto a receiver block of a support pier
Figure 14:
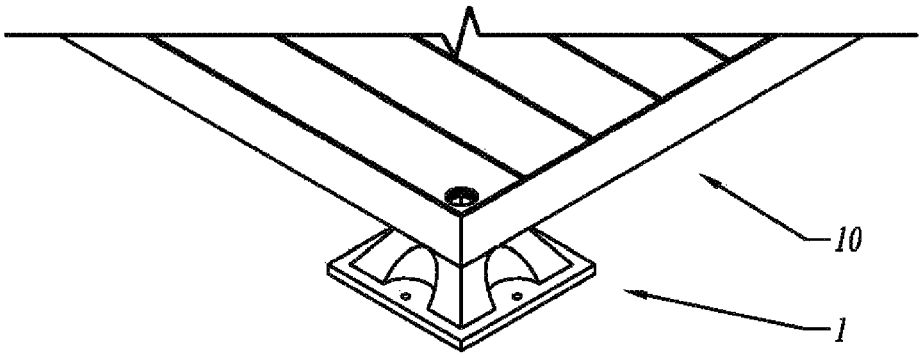
FIG. 14 is a detail isometric view illustrating a surface pad corner that can be secured to a support pier at any one of four possible points of engagement.
Figure 15:
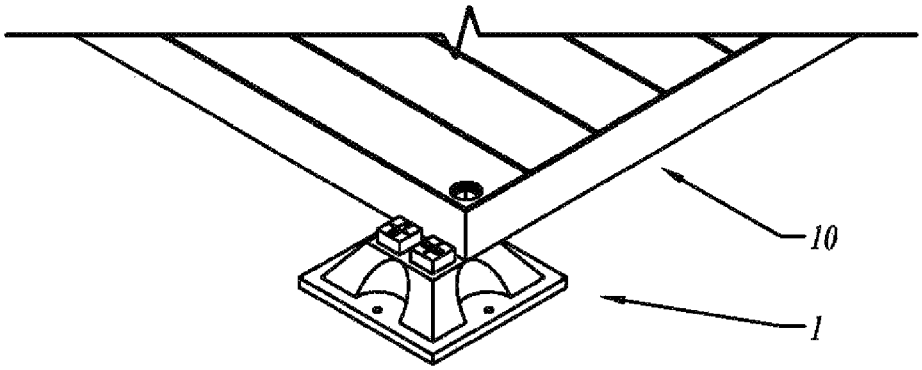
FIG. 15 is a detail isometric view illustrating a surface pad corner that can be secured to a support pier at any one of four possible points of engagement.
Figure 16:
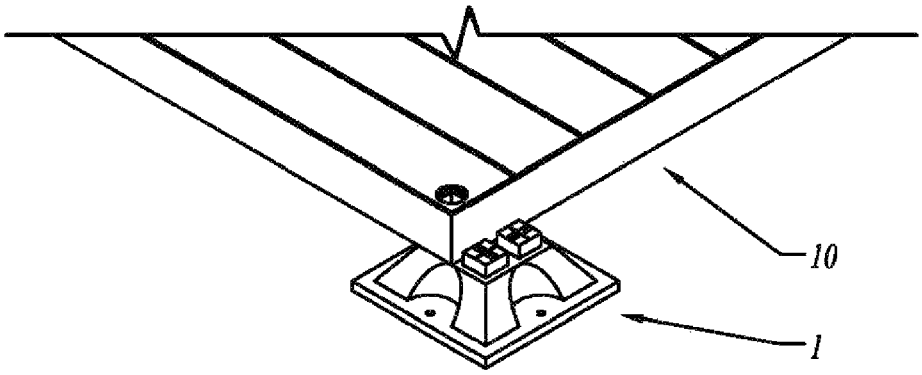
FIG. 16 is a detail isometric view illustrating a surface pad corner that can be secured to a support pier at any one of four possible points of engagement.
Figure 17:
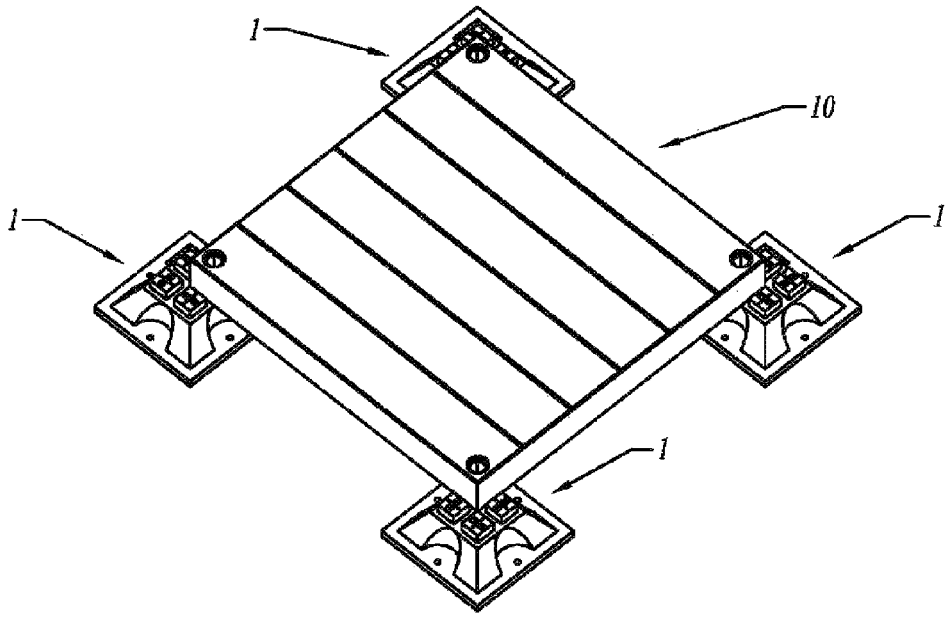
FIG. 17 is a top isometric view of a surface pad secured to a corresponding number of support piers according to an embodiment of the invention.
Figure 18:
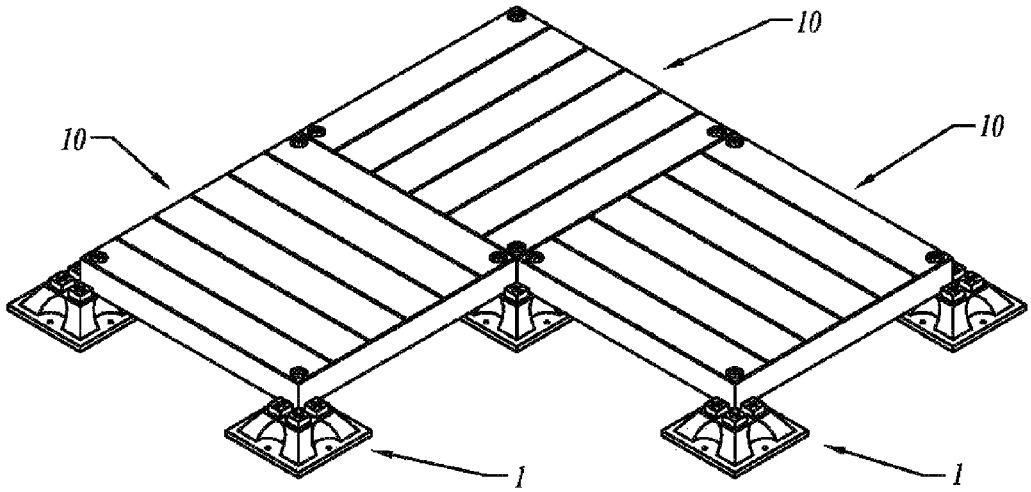
FIG. 18 is a top isometric view of adjacent pads and piers assembled to form a surface shape according to another embodiment of the invention.

As shown in FIG. 12, surface pad 10 aligns and engages with receiver block 5, which is part of structural pier 1. Once aligned, FIG. 13 shows surface pad 10 engaged with structural pier 1. As shown in FIG. 14, FIG. 15, and FIG. 16, a corner surface pad 10, can engage with receiver blocks on structural pier 1 in four possible configurations. A surface pad 10 engages with structural pier one at each corner, as shown in FIG. 17. Further illustrating the assembly process, FIG. 18 expands upon FIG. 17 by placing surface pad 10 adjacent to surface pad 10 on structural piers 1.

Figure 19:
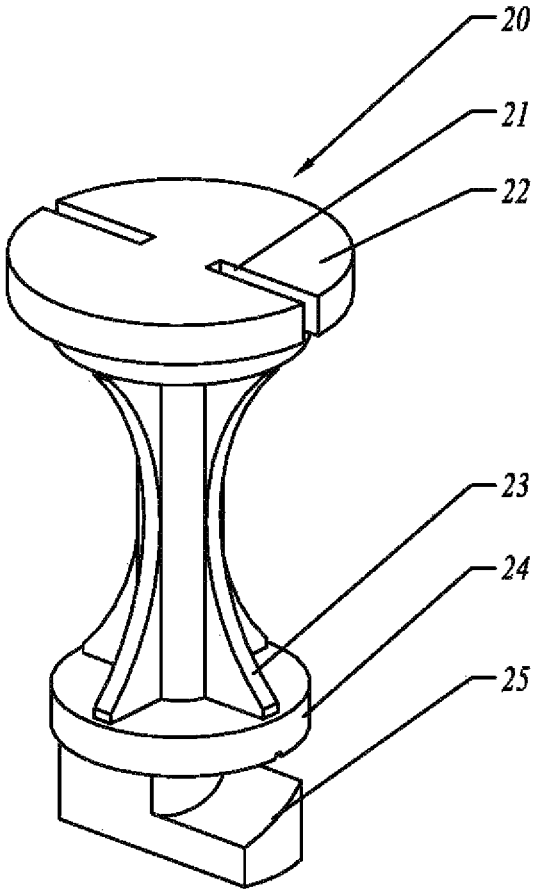
FIG. 19 is a top isometric view of the cam lock according to an embodiment of the invention.
Figure 20:
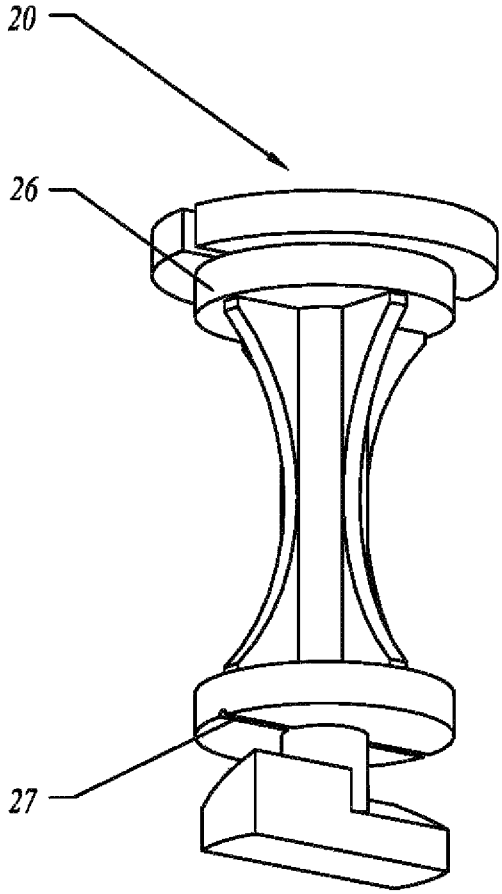
FIG. 20 is a bottom isometric view of the cam lock according to an embodiment of the invention.
Figure 21:
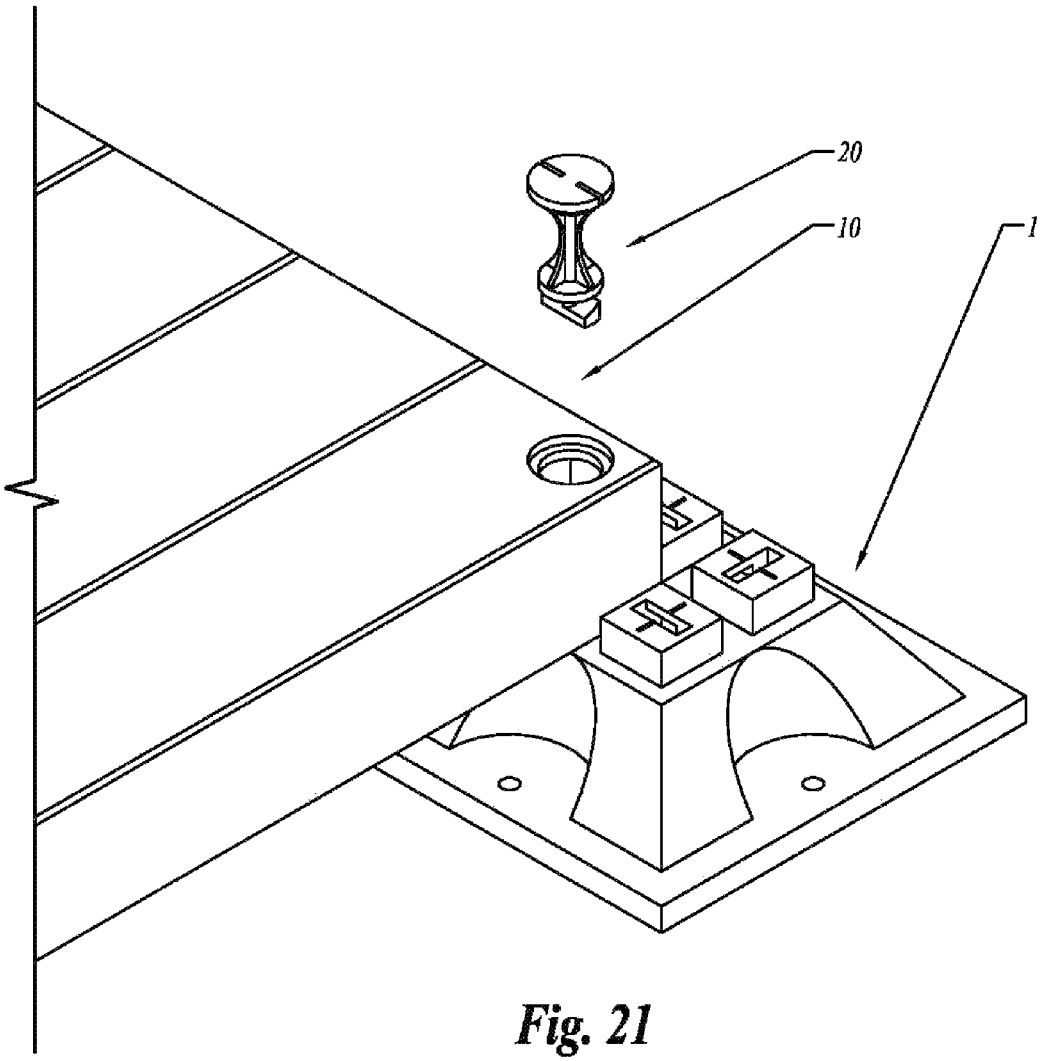
FIG. 21 is a top isometric view illustrating a surface pad resting on a support pier with a cam lock aligned for placement.
Figure 22:
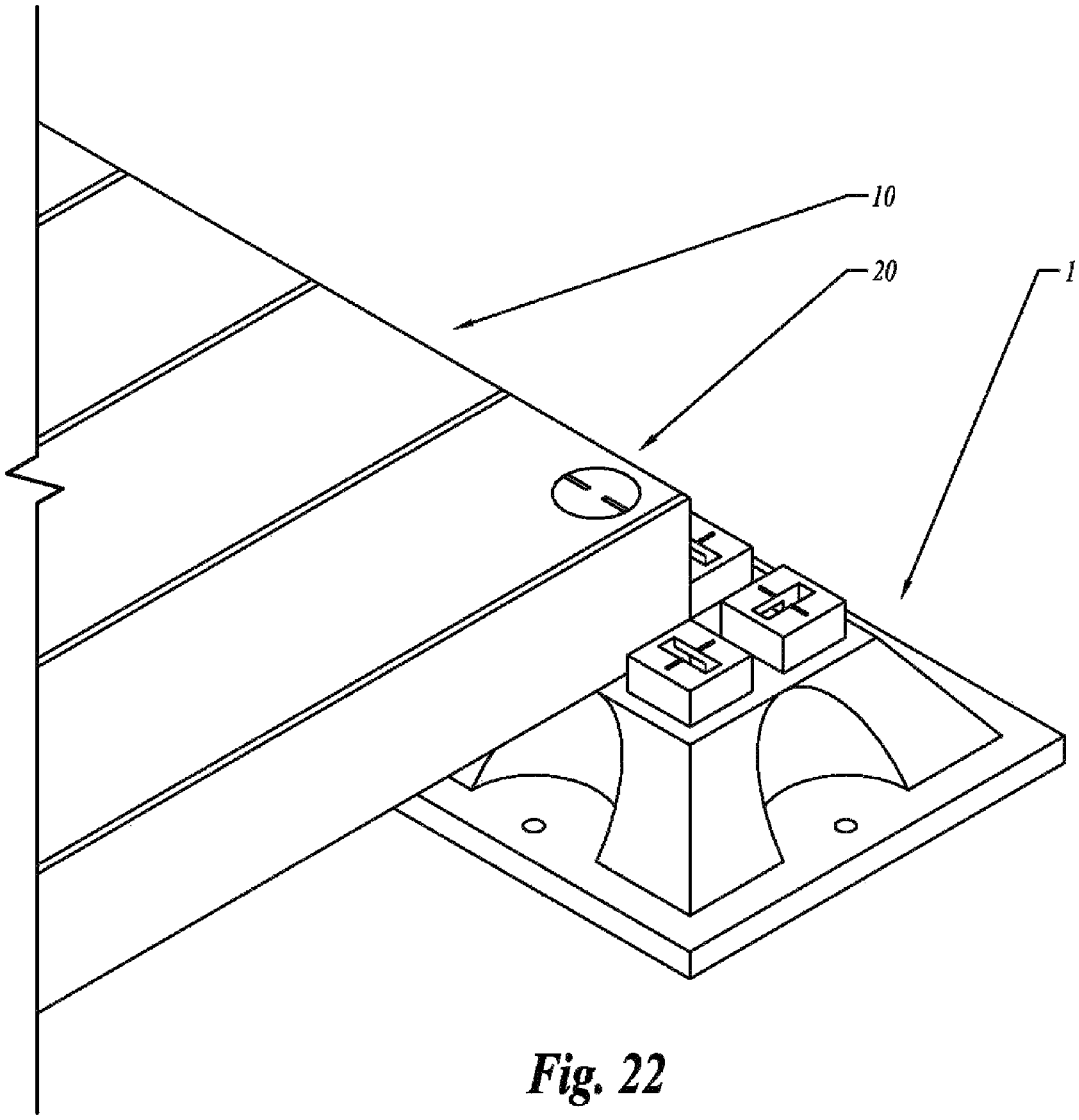
FIG. 22 is a top isometric view showing a surface pad secured to a support pier via means of a cam lock in place.

As shown in FIG. 19, cam lock fastener 20 has receiver slots 21 on cam lock surface 22 that engage with the hand tool to secure the cam lock fastener 20 in place. Additional elements of the cam lock fastener 20 are the structural support ribs 23 and ramped cam component 25. As shown in FIG. 20, female détente 27 engages with receiver block male détente 3 of structural pier 1. Female détente 27 is molded into alignment collar 24 and engages with male détente 3 of receiver block 5 of structural pier 1. The cam lock fastener 20 passes through hole 11 engaging with surface pad 10 to secure with structural pier 1, as shown in FIG. 21. FIG. 22 shows cam lock fastener 20 fully engaged with surface pad 10 and structural pier 1.

Figure 23:
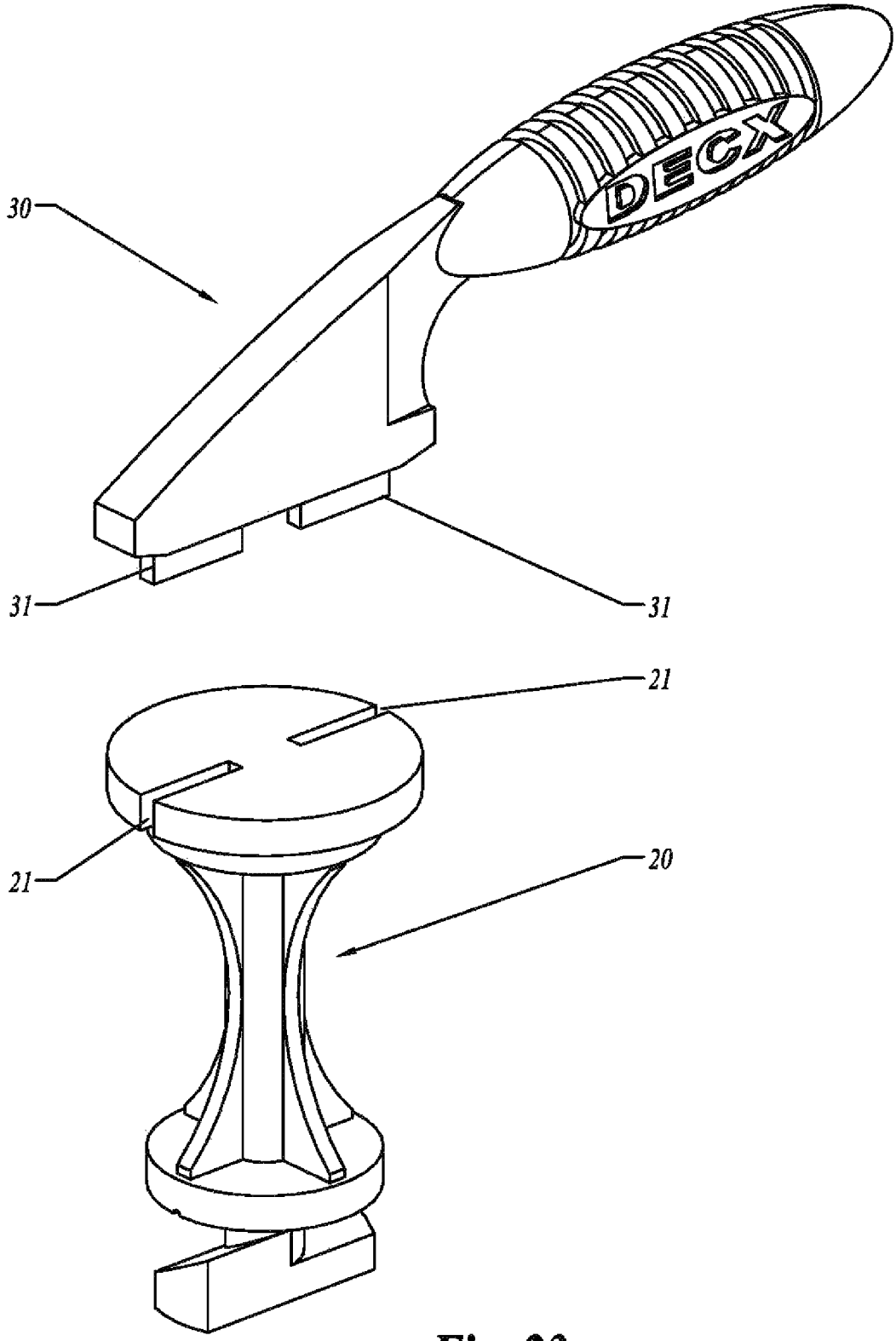
FIG. 23 is a top isometric view of a cam lock and a hand tool according to an embodiment of the invention.
Figure 24:
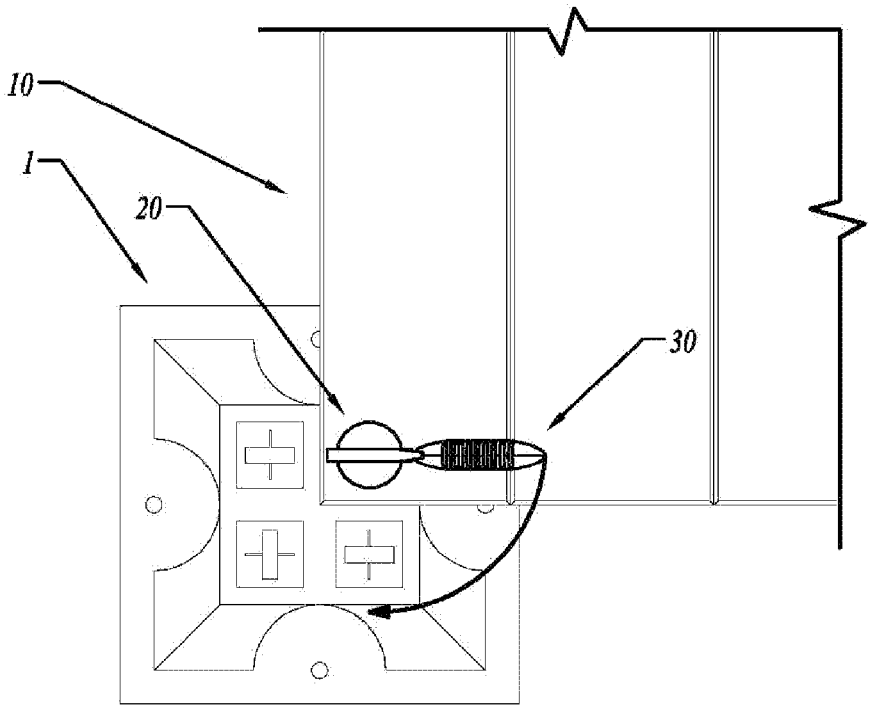
FIG. 24 is a top view of a hand tool in position to rotate a cam lock.
Figure 25:
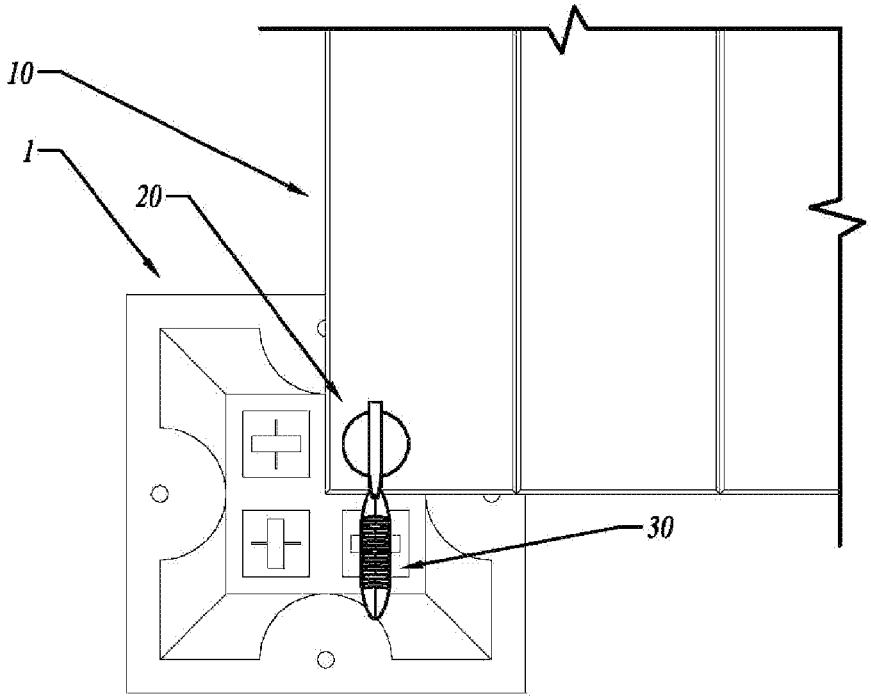
FIG. 25 is a top view of a hand tool rotating a cam lock 90 degrees in a clockwise fashion.
Figure 26:
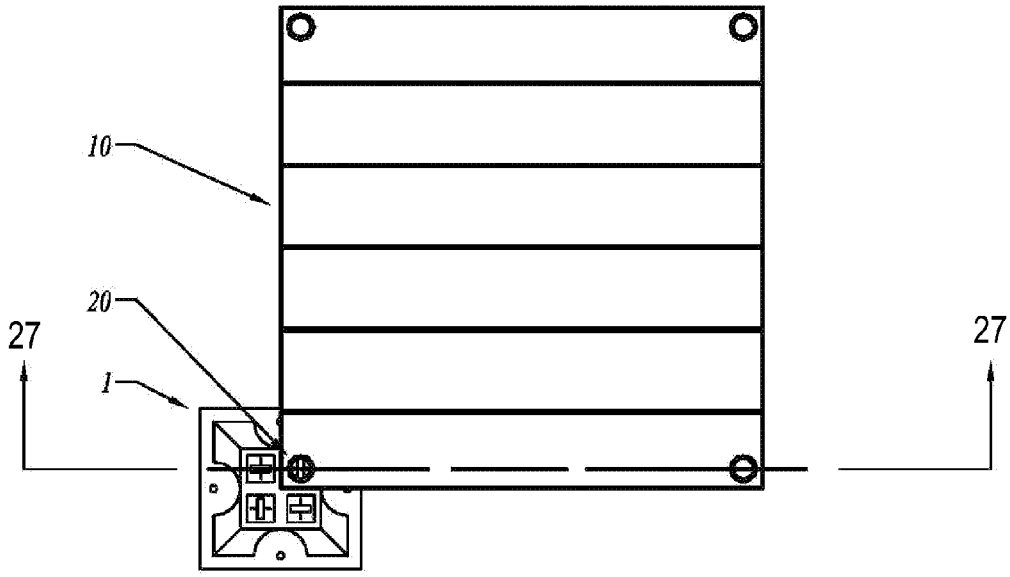
FIG. 26 is a top view of a surface pad, structural pier, and cam lock.

As shown in FIG. 23, custom hand tool 30 engages with cam lock fastener 20 receiver slots 21 via molded driver blades 31. The custom hand tool 30 is used to rotate cam lock fastener 20 ninety degrees in a clockwise fashion until female detent aligns with male detent and provides tactile feedback, to secure surface pad 10 to structural pier 1, as shown in FIG. 25.

Figure 27:
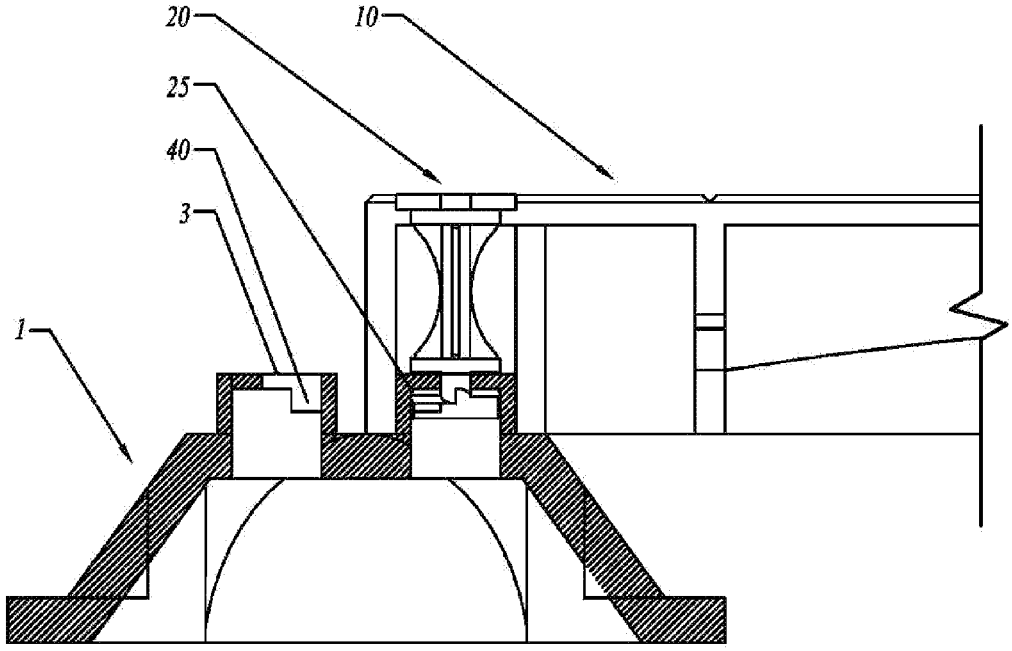
FIG. 27 is a section view of the surface pad of FIG. 26, support pier, and cam lock engagement.
Figure 28:
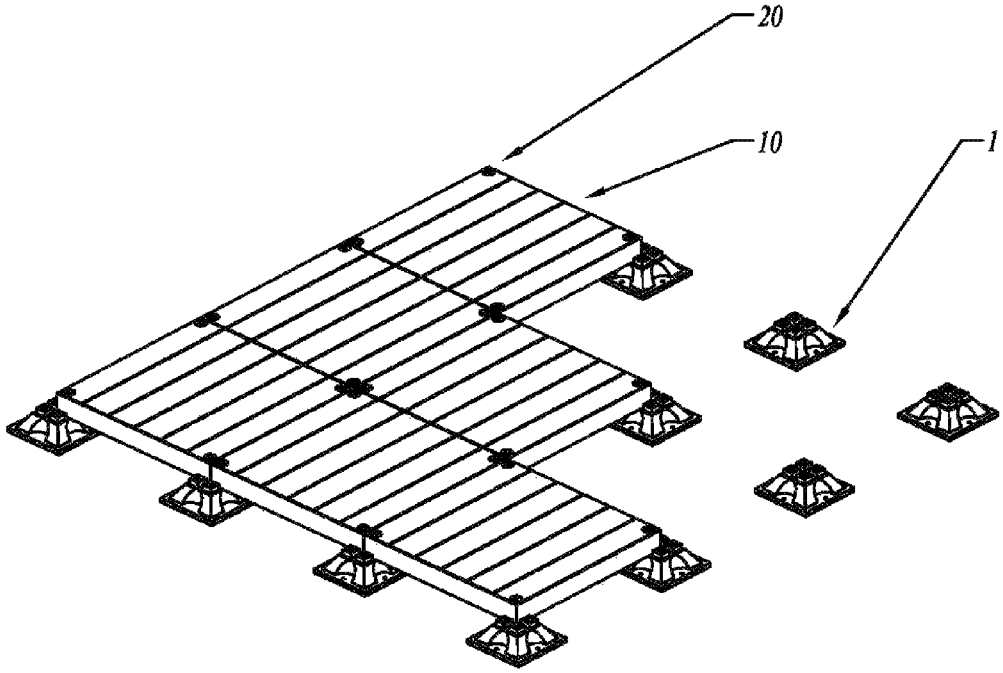
FIG. 28 is a top isometric view of successively installed piers, pads, and cam locks.

As shown in section detail in FIG. 27, cam lock fastener 20 engages with receiver block 5 of structural pier 1. Molded stop 40 prevents the cam lock fastener 20 from being rotated more than ninety degrees.

Figure 29:
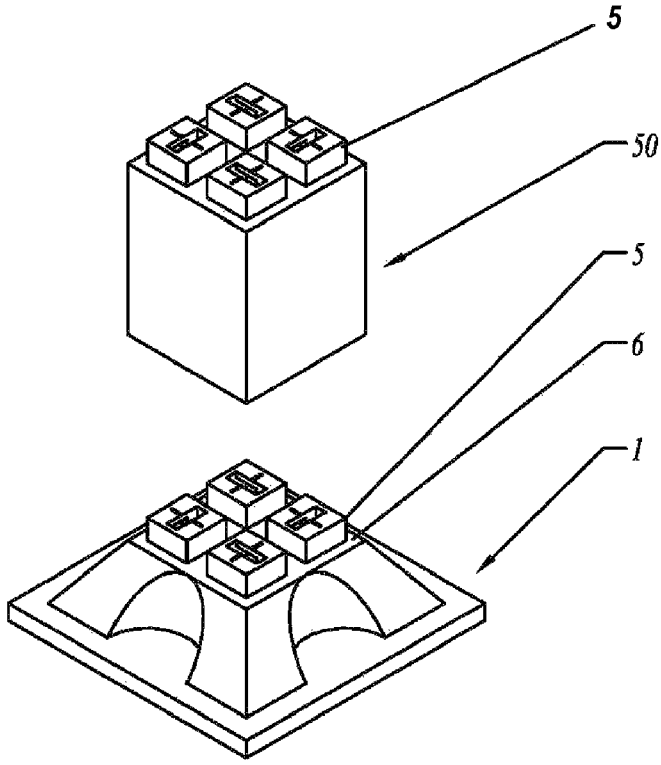
FIG. 29 is a top isometric view of a pier extension block aligned with a structural pier.
Figure 30:
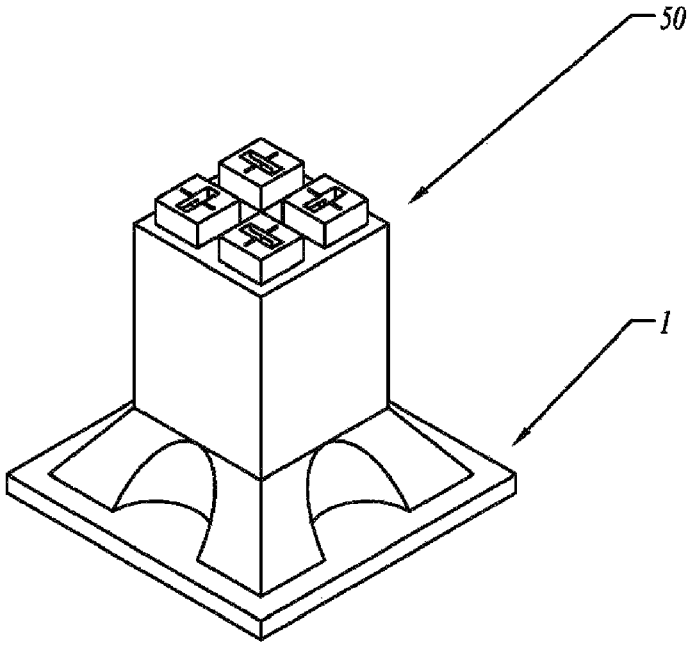
FIG. 30 is a top isometric view of a pier extension blocked engaging a structural pier.
Figure 31:
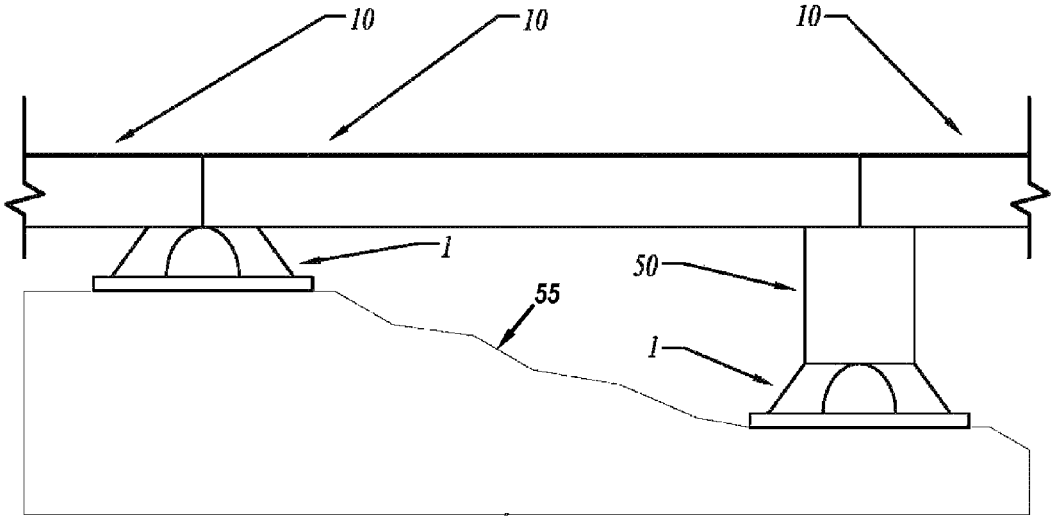
FIG. 31 is an elevation view illustrating the use of a pier extension on sloped grade.
Figure 32:
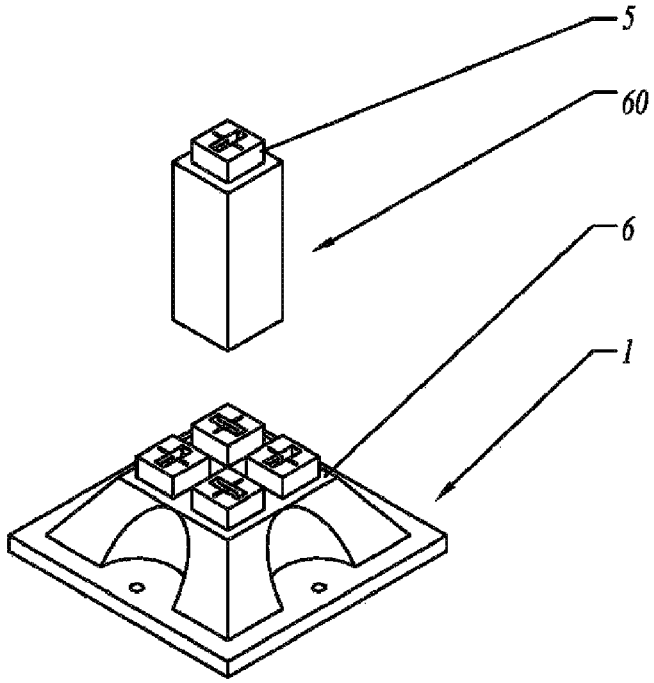
FIG. 32 is a top isometric view of a step block aligned with a structural pier.
Figure 33:
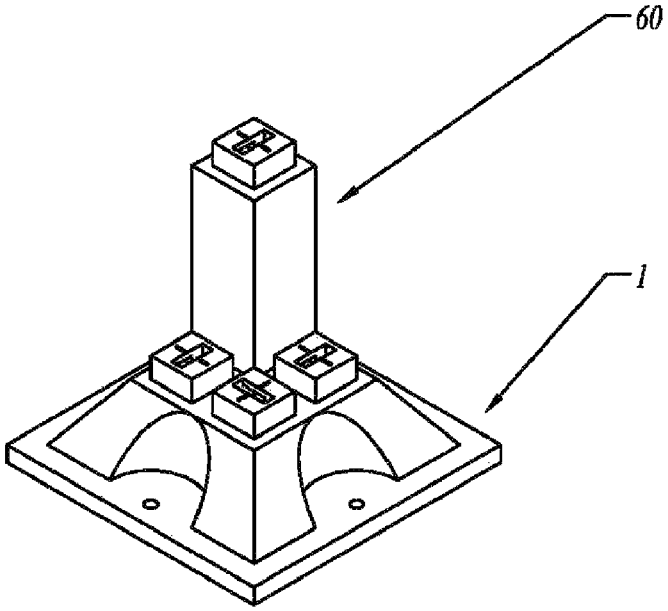
FIG. 33 is a top isometric view a step block engaging a structural pier.
Figure 34:
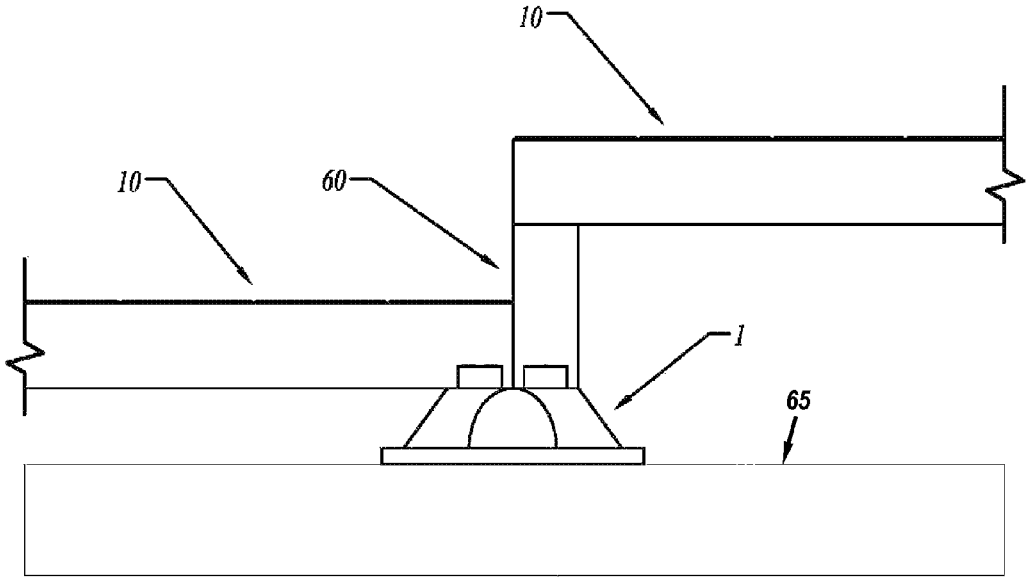
FIG. 34 is an elevation view illustrating the use of a step block to create multi-level surfaces.

As shown in FIG. 29 and FIG. 30, pier extension block 50 includes receiver blocks 5, and engages with top bearing plate 6. The pier extension block 50 engages with receiver blocks 5 of structural pier 1. The pier extension block 50 is utilized when the system is installed over a sloped grade. As shown in FIG. 31, pier extension block 50 is utilized to address the shown sloped grade 55, by engaging with structural pier 1 and surface pad 10. Similar to the pier extension block, as shown in FIG. 32 and FIG. 33, a step block 60 engages with receiver block 5 to allow for multiple planes of the decking system. FIG. 34 further illustrates step block 60 engaging with structural pier 1 and surface pads 10, providing multiple surface levels. Structural pier 1 is installed over a grade 65.

Figure 35:
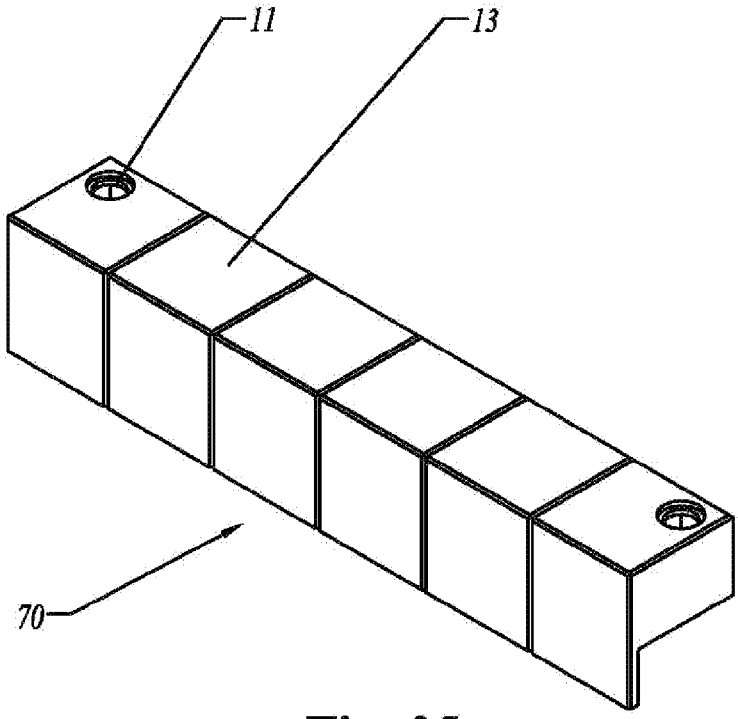
FIG. 35 is a top isometric view of a module of perimeter skirting and disclosing certain aspects of an embodiment of the present invention.
Figure 36:
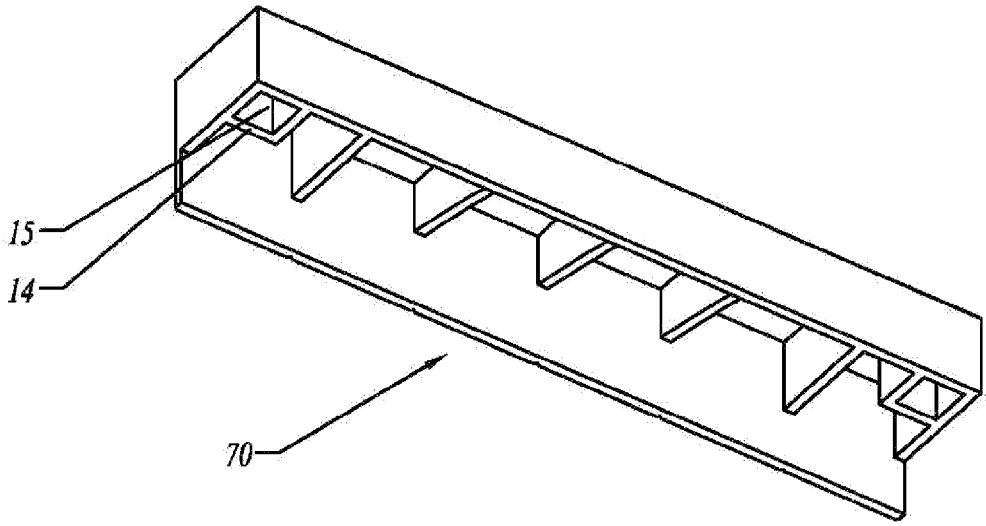
FIG. 36 is a bottom isometric view of a perimeter skirting module according to an embodiment of the invention.
Figure 37:
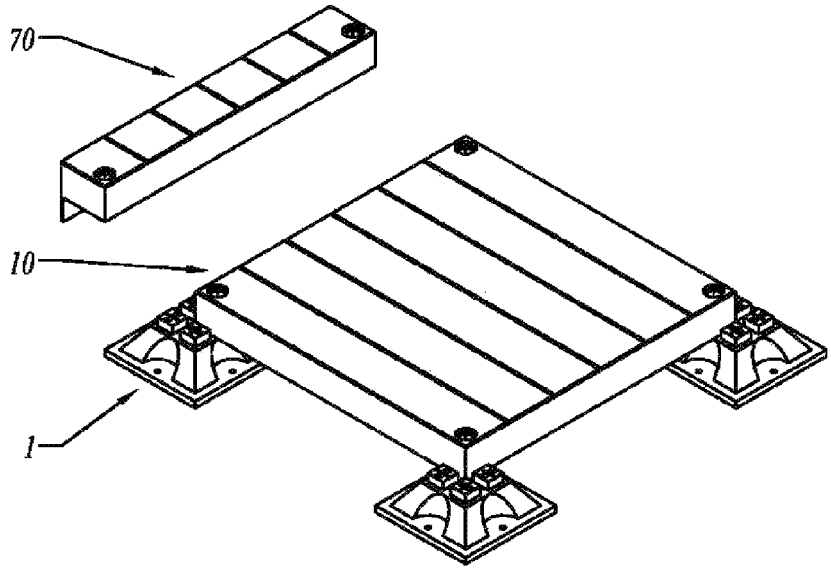
FIG. 37 is a top isometric view of a perimeter skirting module aligned with surface pad and support piers.
Figure 38:
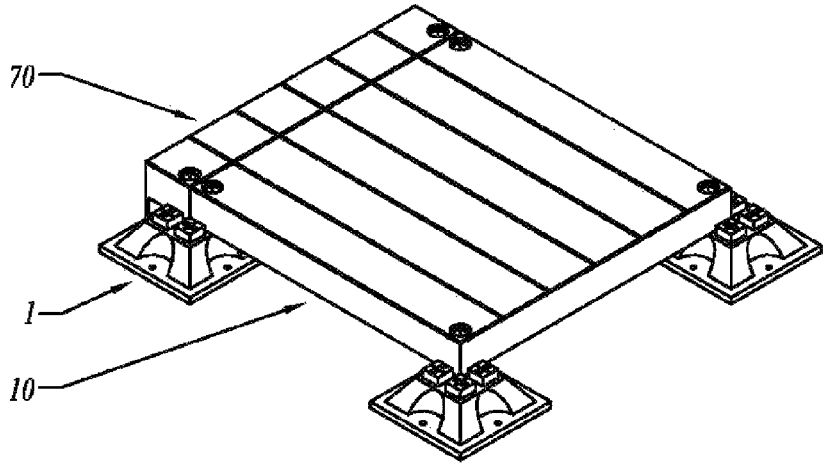
FIG. 38 is a top isometric view of perimeter skirting module engaging support pier.

As shown in FIG. 35 and FIG. 36, perimeter skirting 70 includes recess hole 11, load bearing surface 15 and engaging surface 14. As shown in FIG. 37 and FIG. 38, perimeter skirting 70 engages with structural pier 1, butting up against outer side wall of surface pad 10. Perimeter skirting 70 is secured to structural pier 1 by means of aforementioned cam lock fastener 20.

Figure 39:
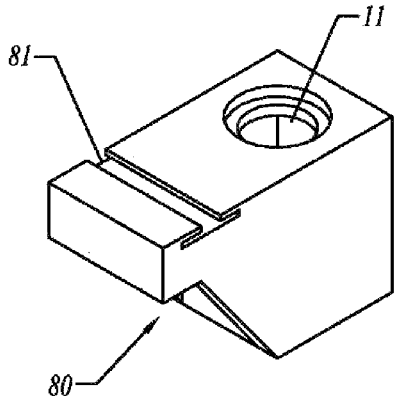
FIG. 39 is a top isometric view of a support block according to an embodiment of the invention.
Figure 40:
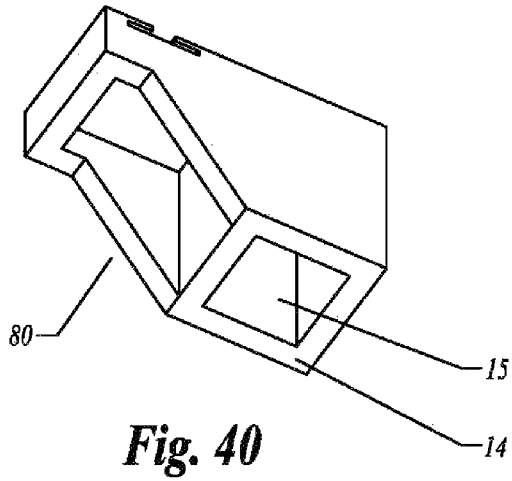
FIG. 40 is a bottom isometric view of a support block according to an embodiment of the invention.
Figure 41:
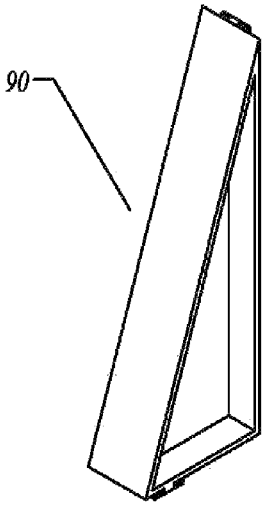
FIG. 41 a top isometric view of a lateral support brace according to an embodiment of the invention.
Figure 42:
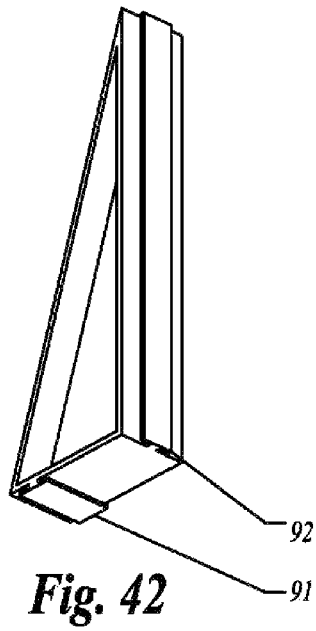
FIG. 42 is a bottom isometric view of a lateral support brace according to an embodiment of the invention.
Figure 43:
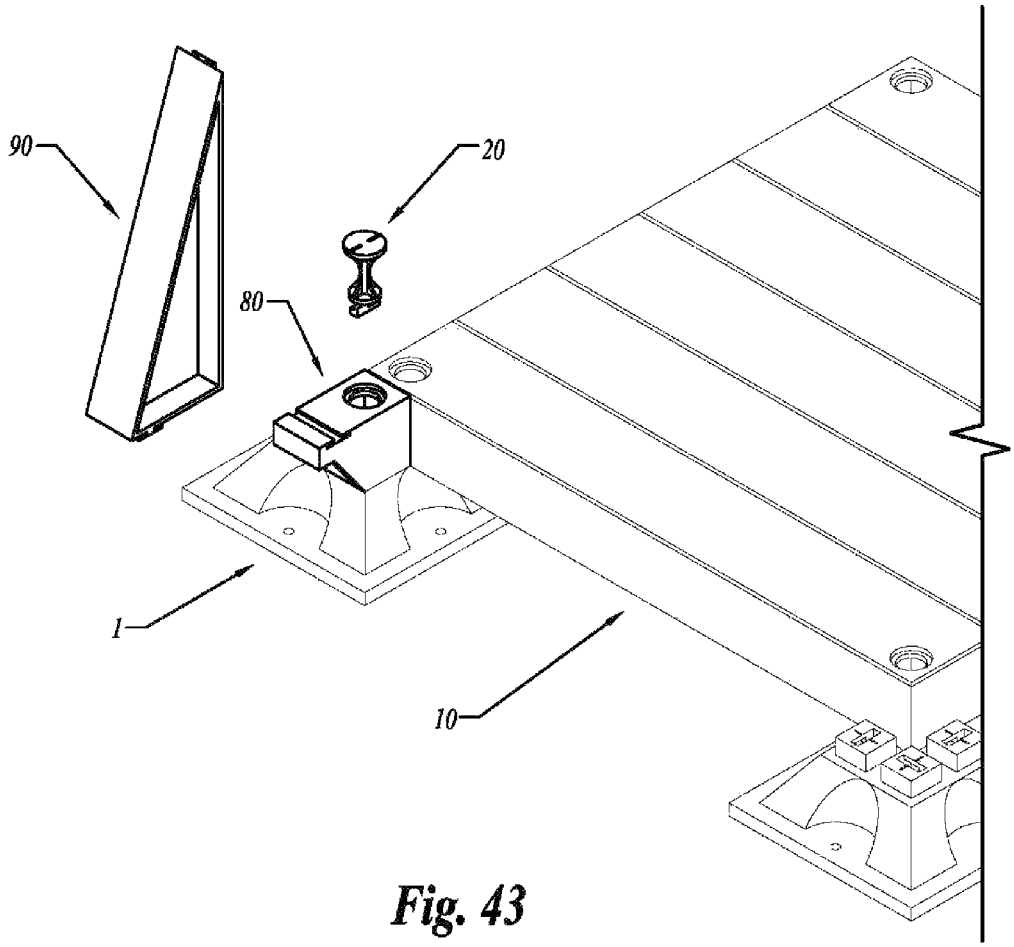
FIG. 43 is a top isometric view of a support block engaging a support pier and a cam lock aligned for installation, and a lateral support brace aligned to engage with support block.

The system includes a multitude of accessory components that engage with the aforementioned receiver blocks 5. As shown in FIG. 39, a railing module component engages with a support block 80, including a molded "T"-slot 81 and a through hole 11 as shown in FIG. 39. As shown in FIG. 41 and FIG. 42, a lateral support brace 90, including a molded "T" fastener 91 and 92 which engage with aforementioned "T" slot 81 of the support block 80. As shown in FIG. 43, support block 80 aligns and engages with structural pier 1, then cam lock fastener 20 is engaged with structural support pier 1. Once cam lock fastener 20 is secured, lateral support brace 90 engages with support block 80 by means of aforementioned "T" fastener 91 and t-slot 81.

Figure 44:
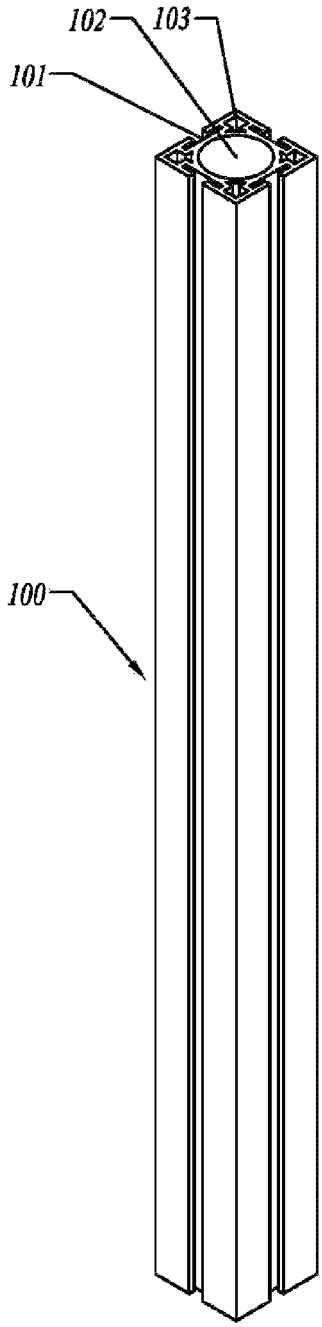
FIG. 44 is a top isometric view of an extruded railing post and defining embodiments.
Figure 45:
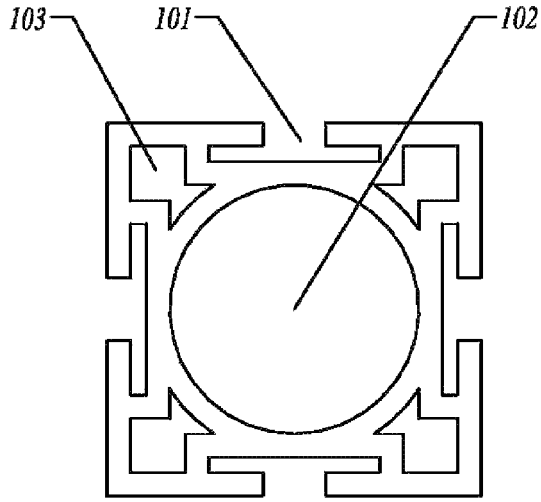
FIG. 45 is a top view of the railing post according to an embodiment of the invention.
Figure 46:
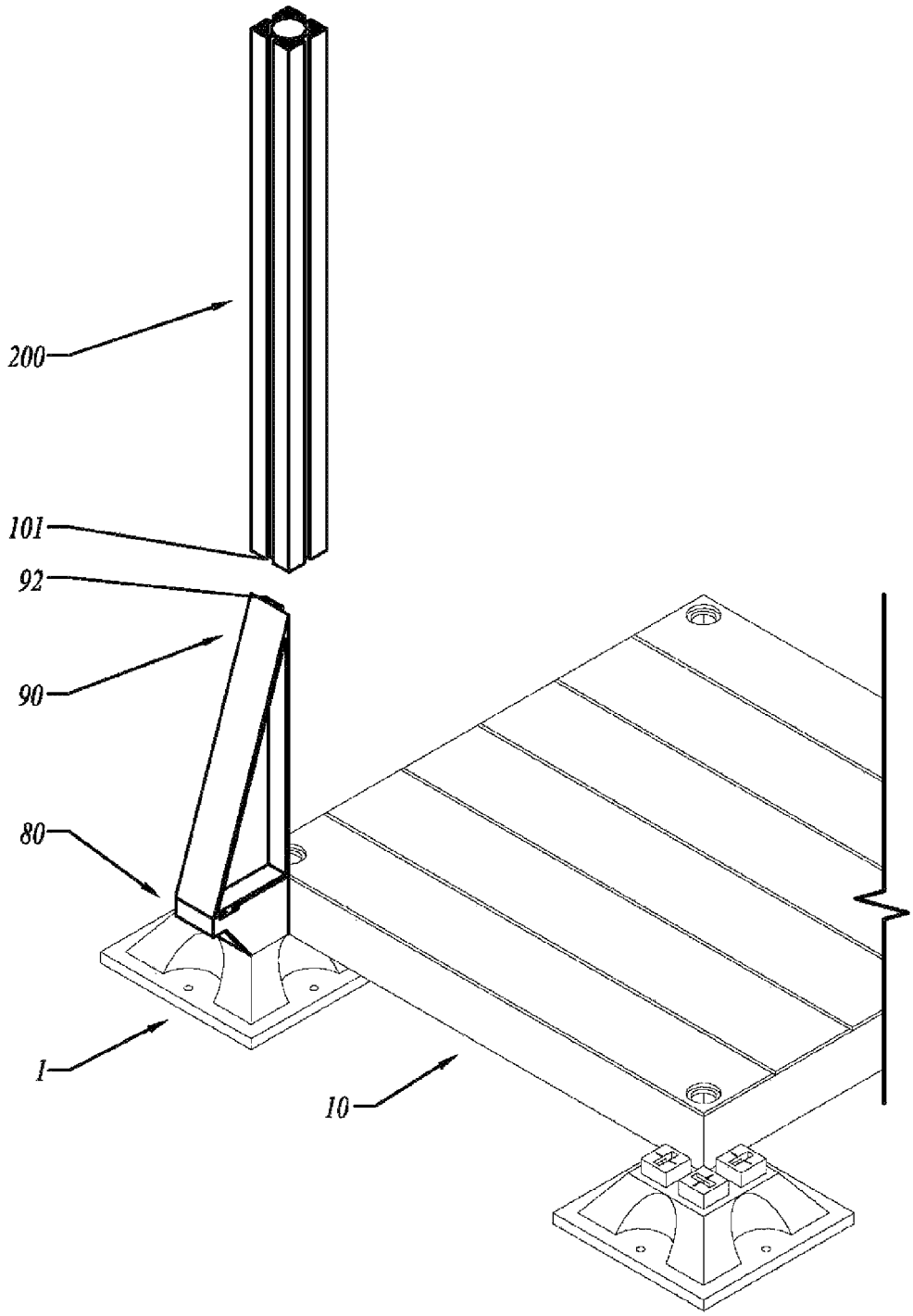
FIG. 46 is a top isometric view of an extruded railing post aligned to engage a lateral support brace.
Figure 47:
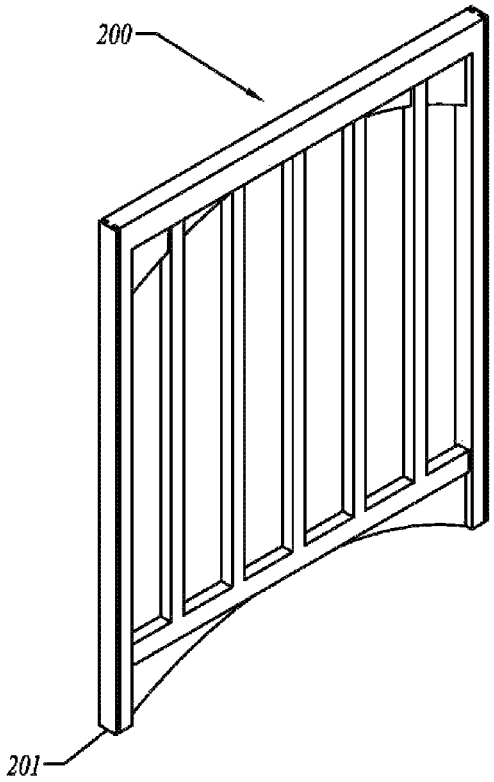
FIG. 47 is a top isometric view of a railing module according to an embodiment of the invention.
Figure 48:
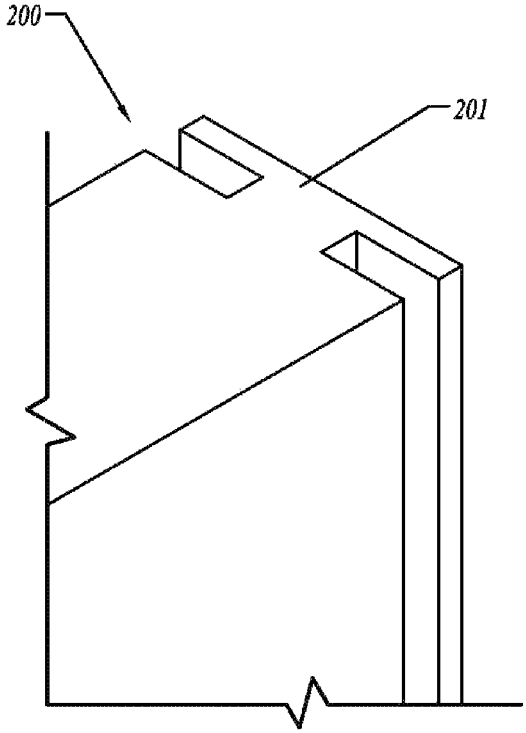
FIG. 48 is a detail isometric view of a railing module according to an embodiment of the invention.
Figure 49:
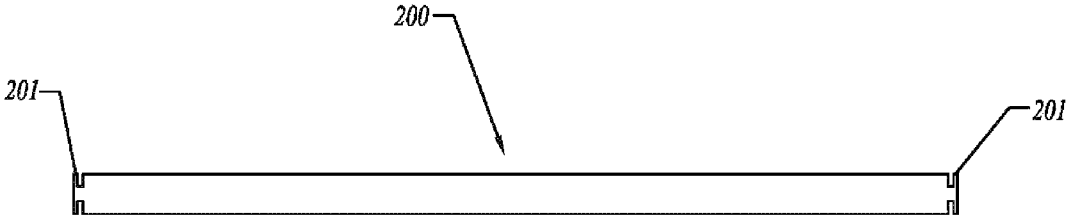
FIG. 49 is a top view of a railing module according to an embodiment of the invention.
Figure 50:
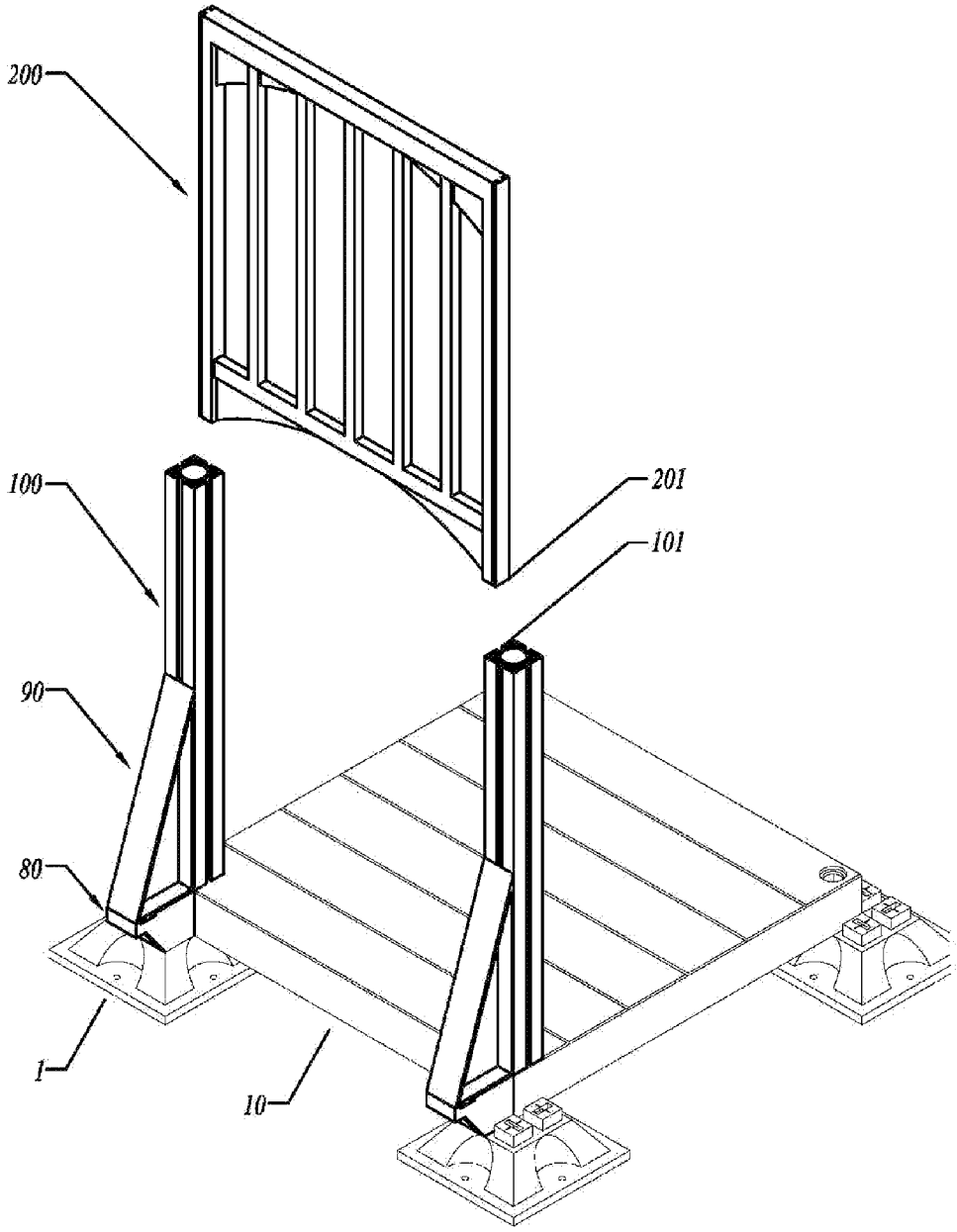
FIG. 50 is a top isometric view of a railing module aligned for engagement with railing posts.
Figure 51:
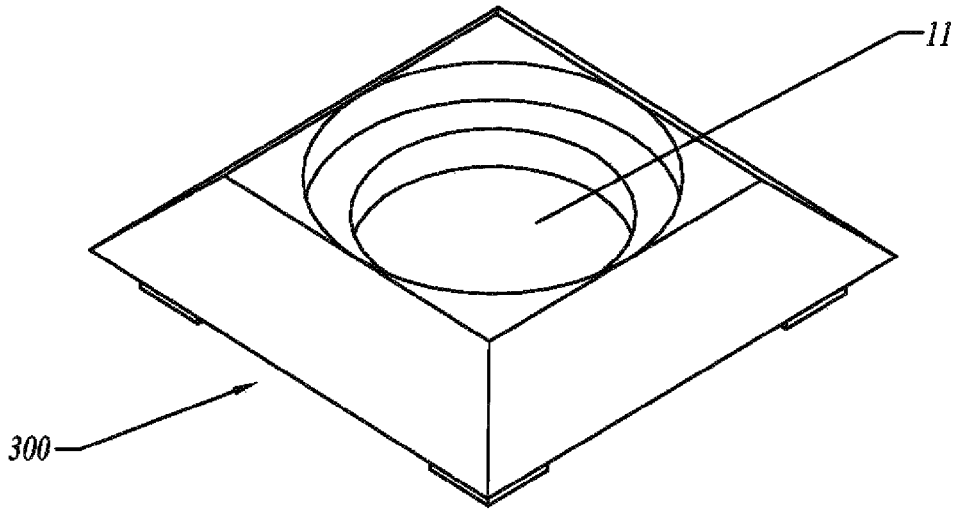
FIG. 51 is a top isometric view of a post cap according to an embodiment of the invention.
Figure 52:
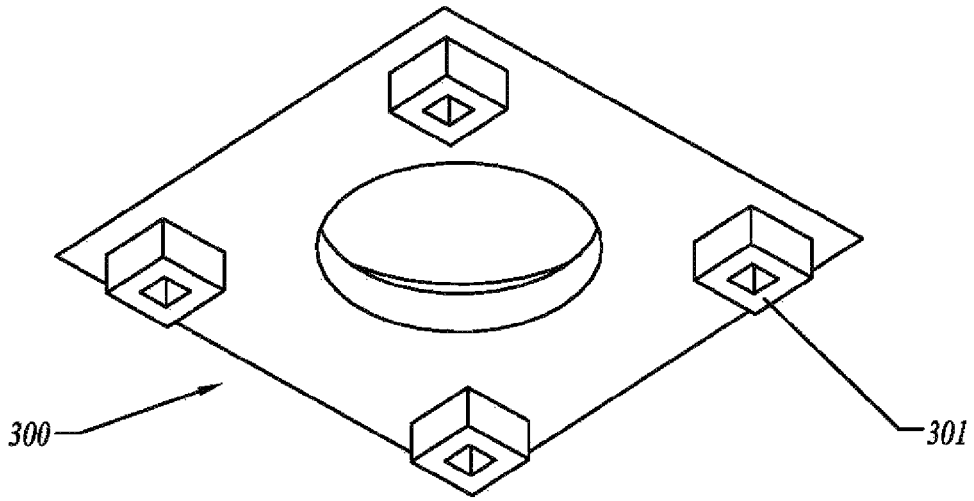
FIG. 52 is a bottom isometric view of a post cap according to an embodiment of the invention.
Figure 53:
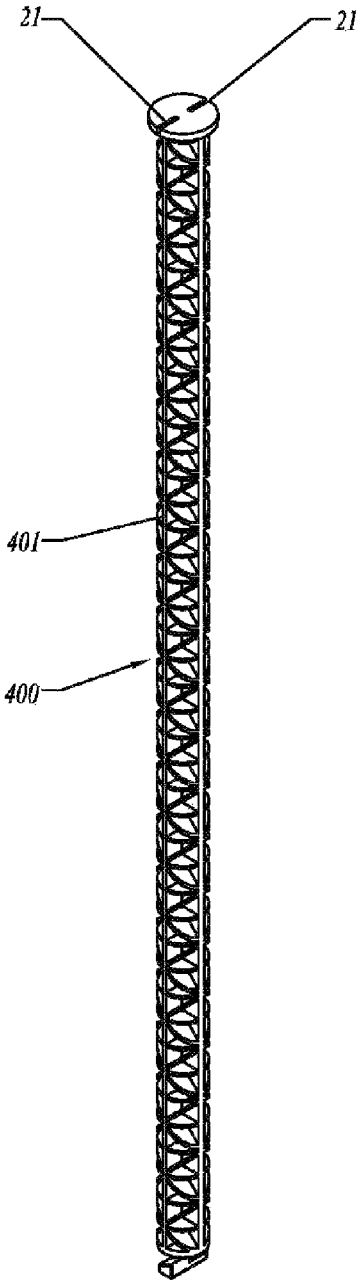
FIG. 53 is a top isometric view of an extended cam lock fastener according to an embodiment of the invention.
Figure 54:
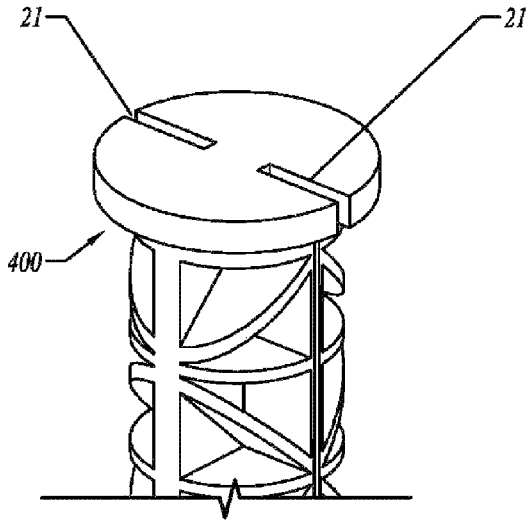
FIG. 54 is a detail isometric view of the extended cam lock according to an embodiment of the invention.
Figure 55:
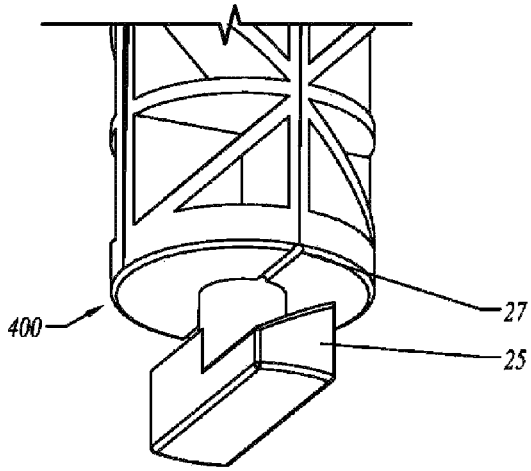
FIG. 55 is a detail isometric view of the extended cam lock according to an embodiment of the invention.
Figure 56:
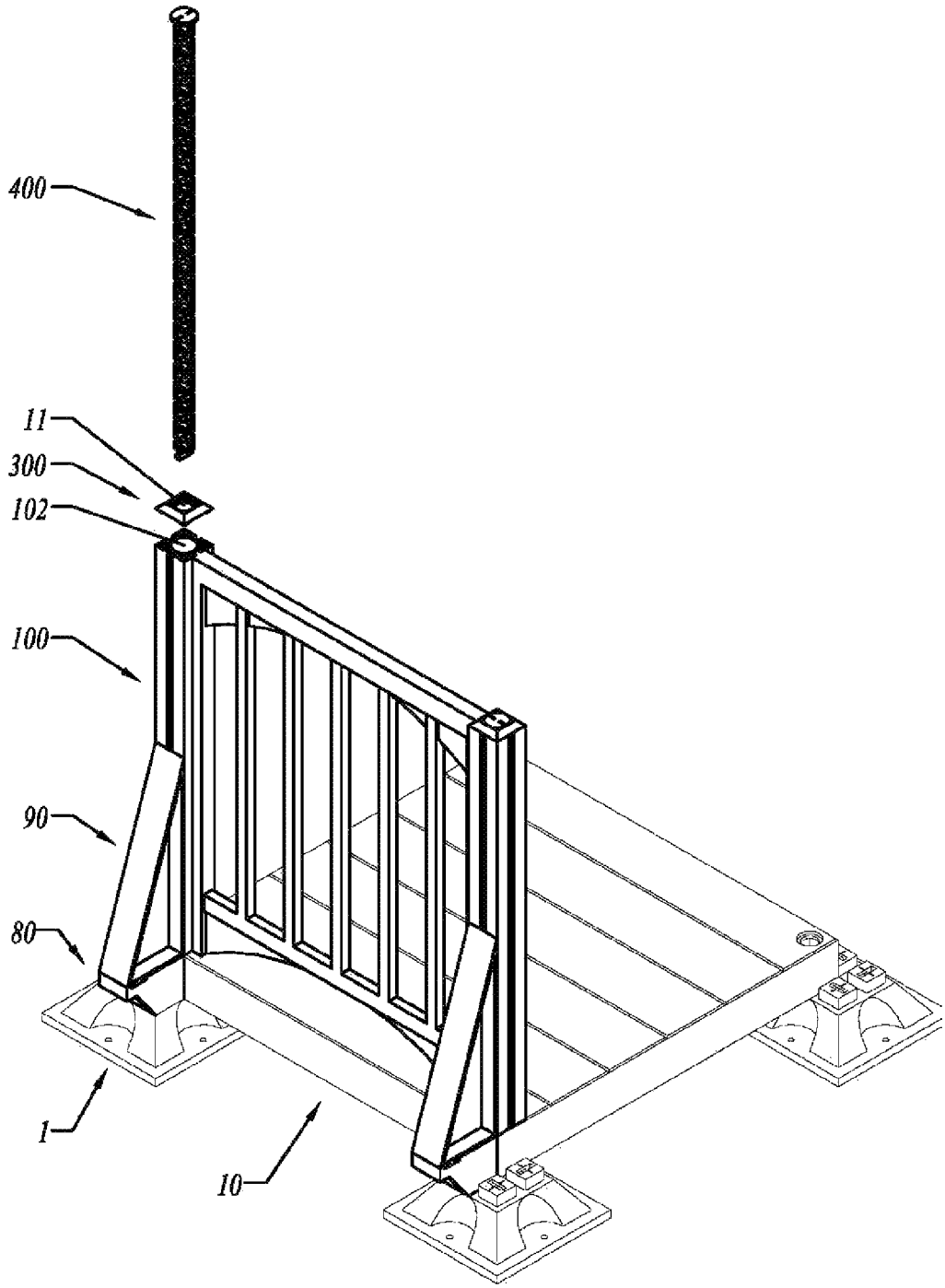
FIG. 56 is a top isometric view of an extended cam lock fastener aligned with a post cap and railing post for engagement with surface pad and pier below.

As shown in FIG. 44 and FIG. 45, the support block 80 is engaged with structural pier 1. Additionally, support brace 90 is engaged with support block 80. Next, an extruded vertical post 100 includes a "T" slot receiver channel 101 and a cylindrical receptacle cavity 102. Extruded receiver block 103 receives alignment boss 301 of post cap 300. The extruded vertical post 100 aligns and engages with lateral support brace 90 by means of LT" fastener 92. As shown in FIG. 47 and FIG. 48, railing module 200 includes "T" fastener 201 to engage with aforementioned support brace 90. Railing module 200 aligns and engages with extruded vertical posts 100, as shown in FIG. 50. As shown in FIG. 51 and FIG. 52, post cap 300 is molded with through hole 11 and alignment boss 301, designed to engage with aforementioned extruded vertical post 100. Completing the railing module, as shown in FIG. 53, an extended cam lock fastener 400, including molded structural ribbing 401, aforementioned receiver slots 21 and ramp cam component 25, is used to pass through post cap 300 and engage with structural pier 1. As shown in FIG. 56, the extended cam lock fastener 400 aligns with post cap 300, passing through hole 11 and the cylindrical receptacle cavity 102 of extruded vertical post 100, securing railing system components to surface pad 10 and structural pier 1.

Figure 57:
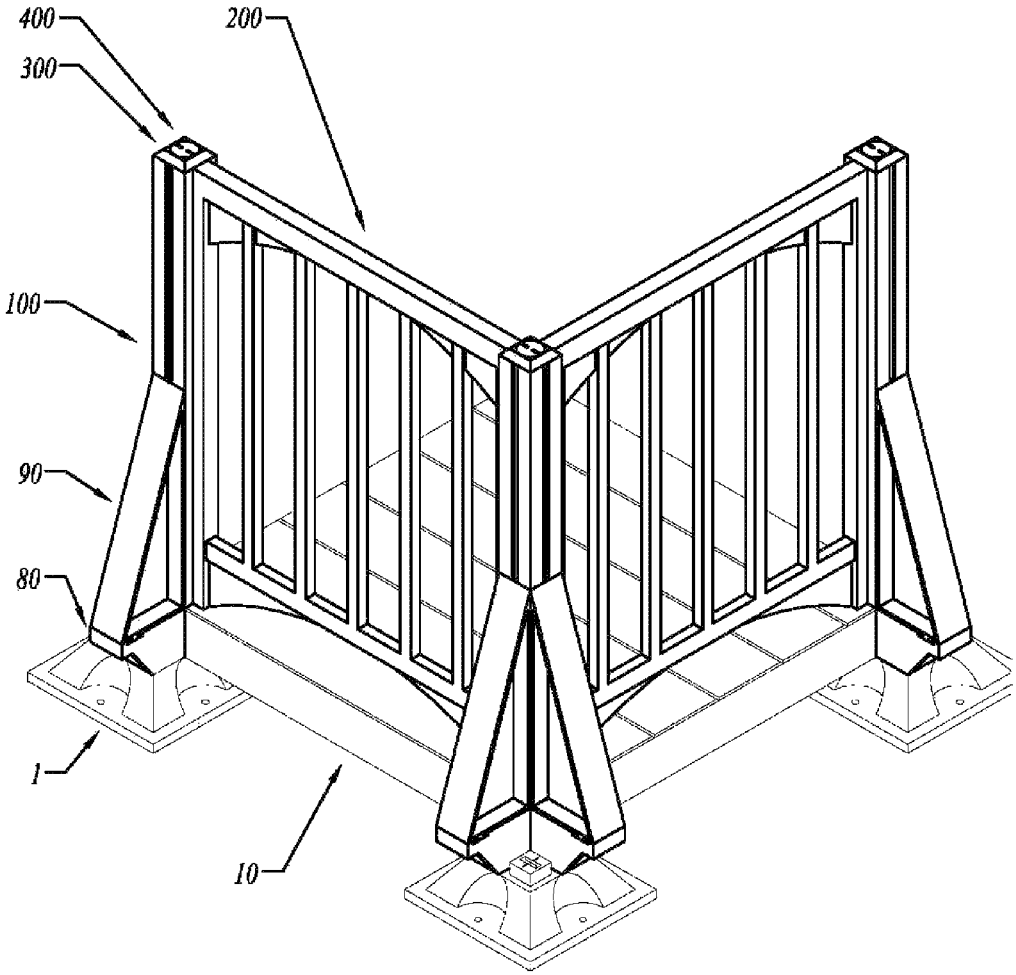
FIG. 57 is a top isometric view of multi directional railing modules sharing a common railing post.

As shown in FIG. 57, extruded vertical post 100 is used to complete and turn the decking system corner, adjoining perpendicular railing modules 200.

Figure 58:
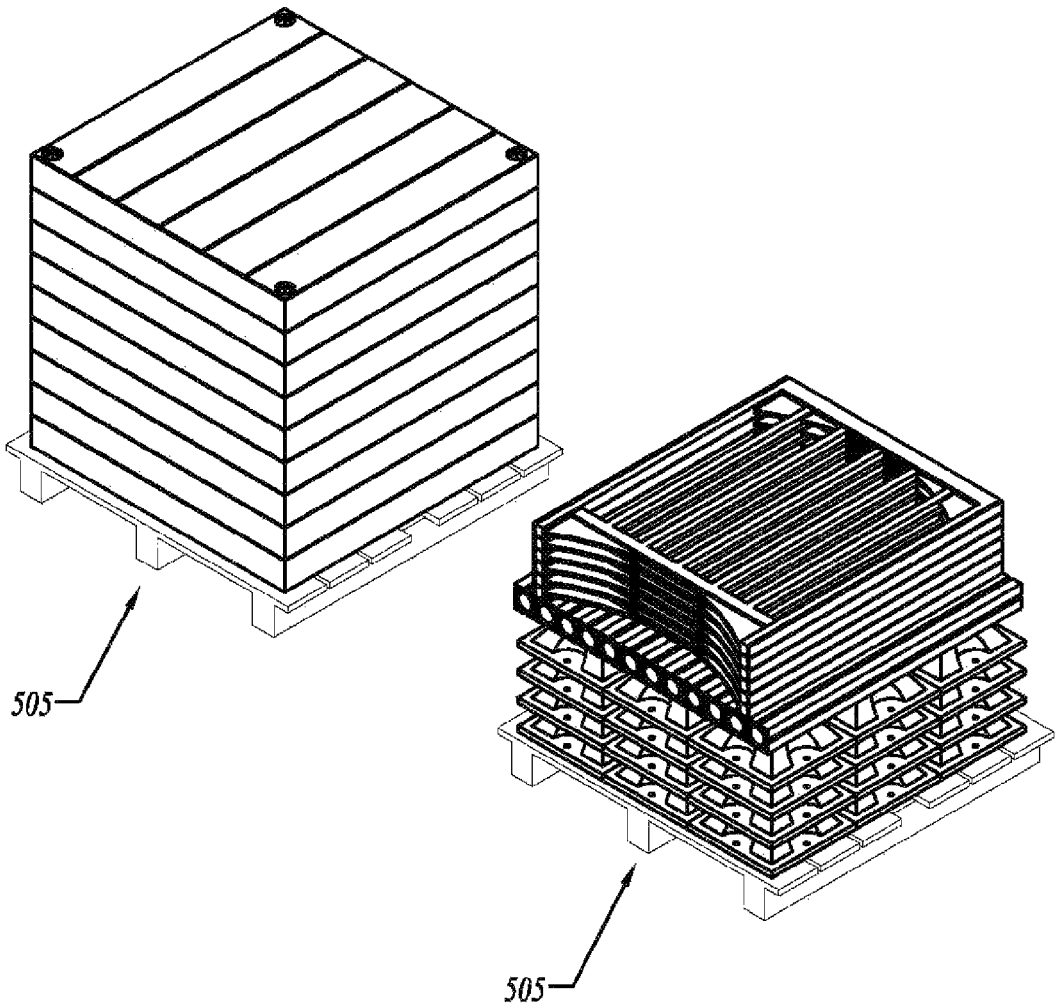
FIG. 58 illustrates components packaged or shipped on standardized pallets.

As shown in FIG. 58, the entire decking system is designed and sized to fit within standardized shipping palettes 505.

Since certain changes may be made in the foregoing disclosure without departing from the scope of the invention herein involved, it is intended that all matter contained in the above description and depicted in the accompanying drawings be construed in an illustrative and not in a limiting case.

What is claimed is:

1. A modular, portable, interlocking decking system comprising:

a plurality of structural piers, each structural pier including a generally planar bearing plate having a bottom surface, each structural pier further including a top surface opposing the bottom surface of the bearing plate;

a plurality of generally hollow receiver blocks in the top surface of each structural pier, each receiver block including a slotted opening and a receiver block detent;

at least one generally rectangular surface pad, the surface pad comprising:

a generally planar, horizontal upper surface, a lower portion, the lower portion including a generally hollow block receptacle at each corner of the surface pad, and at least one fastener opening at each corner of the surface pad, the fastener opening extending from the upper surface to the block receptacle; and a plurality of cam lock fasteners, the cam lock fasteners having a fastener detent configured to engage the receiver block detent, wherein the bottom surface of the bearing plate of each structural pier rests upon a supporting surface and the block receptacles of the surface pad each engage a receiver block of a corresponding structural pier, the surface pad being detachably secured to the structural piers by inserting one of the cam lock fasteners into each fastener opening of the surface pad and into engagement with the slotted opening of a corresponding block receptacle, the receiver block detent engaging the fastener detent when the cam lock fasteners are placed into engagement with the slotted opening of a corresponding receiver block.

2. The decking system of claim 1 wherein the lower portion of the surface pad further includes structural ribs.

3. The decking system of claim 1 wherein the upper surface of the surface pad further includes weep holes for water drainage.

4. The decking system of claim 1 wherein the receiver block further includes a stop to limit rotation of the cam lock fastener when the cam lock fastener is in engagement with the receiver block.

5. The decking system of claim 1 wherein the cam lock fastener further includes a ramp cam portion.

6. The decking system of claim 1 wherein the structural piers further include at least one aperture extending through the bearing plate.

7. The decking system of claim 6, further comprising at least one anchor fastener, the anchor fastener extending through the aperture of the bearing plate and into the support surface to secure the structural pier to the support surface.

8. The decking system of claim 7 wherein the anchor fastener is a spike or a bolt.

9. The decking system of claim 1, further comprising at least one elongated perimeter skirt, the perimeter skirt including:

a generally horizontal skirt surface, a generally vertical skirt face, an interior portion delimited by the skirt surface and the skirt face, the interior portion including a generally hollow skirt block receptacle at opposing ends of the perimeter skirt, and at least one skirt fastener opening at each end of the perimeter skirt, the skirt fastener opening extending from the skirt surface to the skirt block receptacle, wherein the skirt block receptacles each engage a receiver block of a corresponding structural pier, the perimeter skirt being detachably secured to the structural piers by inserting one of the cam lock fasteners into each skirt fastener opening and into engagement with the slotted opening of a corresponding block receptacle.

10. The decking system of claim 1, further comprising a railing assembly, the railing assembly including:

a plurality of support blocks, the support blocks each having a generally hollow support block receptacle, a support block upper surface, at least one support block fastener opening extending from the support block upper surface to the support block receptacle, and a support block connector;

a support brace having a generally horizontal portion and a generally vertical portion, the horizontal and vertical portions each including a support brace connector;

a generally hollow, elongated support post, the support post having a plurality of post connectors; and a railing assembly having at least one railing connector, wherein the support block receptacles each engage a receiver block of a corresponding structural pier, the support blocks being detachably secured to the structural piers by inserting one of the cam lock fasteners into the support block fastener opening and into engagement with the slotted opening of a corresponding receiver block, the support block connector being detachably coupled to the brace connector of the horizontal portion of the support brace to join the support brace to the support block, the brace connector of the vertical portion of the support brace being detachably coupled to a first post connector to join the post to the support brace, and the railing connector of the railing assembly being coupled to a second post connector to detachably join the railing assembly to the post.

11. The decking system of claim 10 wherein the support post further includes a post cap.

12. The decking system of claim 10, further including an extended cam lock fastener, the extended cam lock fastener extending through the post and the surface pad, into engagement with the slotted opening of a corresponding structural pier to detachably join the post and the surface pad to the structural pier.

13. The decking system of claim 1, further comprising a tool configured to rotatably urge the cam lock fasteners into engagement with the slotted opening of a corresponding block receptacle.

14. The decking system of claim 1, further comprising a pier extension block having an extension block top surface and an opposing extension block receptacle, the extension block top surface further including a plurality of generally hollow extension block receivers, each extension block receiver including a slotted opening, the pier extension block being interposed between the surface pad and the structural pier, the extension block receptacle engaging each of the receiver blocks of the structural pier, and an extension block receiver block engaging the block receptacle of the surface pad, the surface pad being detachably secured to the structural piers by inserting one of the cam lock fasteners into the fastener opening of the surface pad, through the extension block, and into engagement with the slotted opening of a block receptacle of a corresponding structural pier.

15. The decking system of claim 1, further comprising a step block having a step block top surface and an opposing step block receptacle, the step block top surface further including a generally hollow step block receiver having a slotted opening, the step block being interposed between the surface pad and the structural pier, the step block receptacle engaging a receiver block of the structural pier, and the step block receiver engaging the block receptacle of the surface pad, the surface pad being detachably secured to the structural piers by inserting one of the cam lock fasteners into the fastener opening of the surface pad, through the step block, and into engagement with the slotted opening of a block receptacle of a corresponding structural pier.

16. A modular, portable, interlocking decking system comprising:

a plurality of structural piers, each structural pier including a generally planar bearing plate having a bottom surface, each structural pier further including a top surface opposing the bottom surface of the bearing plate;

a plurality of generally hollow receiver blocks in the top surface of each structural pier, each receiver block including a slotted opening;

at least one generally rectangular surface pad, the surface pad comprising:

a generally planar, horizontal upper surface, a lower portion, the lower portion including a generally hollow block receptacle at each corner of the surface pad, and at least one fastener opening at each corner of the surface pad, the fastener opening extending from the upper surface to the block receptacle;

a plurality of cam lock fasteners;

at least one elongated perimeter skirt, the perimeter skirt including:

a generally horizontal skirt surface, a generally vertical skirt face, an interior portion delimited by the skirt surface and the skirt face, the interior portion including a generally hollow skirt block receptacle at opposing ends of the perimeter skirt, and at least one skirt fastener opening at each end of the perimeter skirt, the skirt fastener opening extending from the skirt surface to the skirt block receptacle; and a railing assembly, the railing assembly including:

a plurality of support blocks, the support blocks each having a generally hollow support block receptacle, a support block upper surface, at least one support block fastener opening extending from the support block upper surface to the support block receptacle, and a support block connector, a support brace having a generally horizontal portion and a generally vertical portion, the horizontal and vertical portions each including a support brace connector, a generally hollow, elongated support post, the support post having a plurality of post connectors, and a railing assembly having at least one railing connector, wherein the skirt block receptacles each engage a receiver block of a corresponding structural pier, the perimeter skirt being detachably secured to the structural piers by inserting one of the cam lock fasteners into each skirt fastener opening and into engagement with the slotted opening of a corresponding block receptacle, wherein the bottom surface of the bearing plate of each structural pier rests upon a supporting surface and the block receptacles of the surface pad each engage a receiver block of a corresponding structural pier, the surface pad being detachably secured to the structural piers by inserting one of the cam lock fasteners into each fastener opening of the surface pad and into engagement with the slotted opening of a corresponding block receptacle, and wherein the support block receptacles each engage a receiver block of a corresponding structural pier, the support blocks being detachably secured to the structural piers by inserting one of the cam lock fasteners into the support block fastener opening and into engagement with the slotted opening of a corresponding receiver block, the support block connector being detachably coupled to the brace connector of the horizontal portion of the support brace to join the support brace to the support block, the brace connector of the vertical portion of the support brace being detachably coupled to a first post connector to join the post to the support brace, and the railing connector of the railing assembly being coupled to a second post connector to detachably join the railing assembly to the post.

17. The decking system of claim 16, wherein:

the receiver blocks further include a receiver block detent; and the cam lock fasteners further include a fastener detent configured to engage the receiver block detent, the receiver block detent engaging the fastener detent when the cam lock fasteners are urged into engagement with the slotted opening of a corresponding receiver block.

18. A method for installing a modular, portable, interlocking decking system comprising the steps of:

providing a plurality of structural piers, each structural pier including a generally planar bearing plate having a bottom surface, each structural pier also including a top surface opposing the bottom surface of the bearing plate, the structural piers further including a plurality of generally hollow receiver blocks in the top surface of each structural pier, each receiver block including a slotted opening and a receiver block detent;

providing at least one generally rectangular surface pad, the surface pad comprising: a generally planar, horizontal upper surface; a lower portion, the lower portion including a generally hollow block receptacle at each corner of the surface pad; and at least one fastener opening at each corner of the surface pad, the fastener opening extending from the upper surface to the block receptacle;

providing a plurality of cam lock fasteners, the cam lock fasteners having a fastener detent configured to engage the receiver block detent;

resting the bottom surface of the bearing plate of each structural pier upon a supporting surface;

engaging each of the block receptacles of the surface pad with a receiver block of a corresponding structural pier; and detachably securing the surface pad to the structural pier by inserting one of the cam lock fasteners into each fastener opening of the surface pad and into engagement with the slotted opening of a corresponding block receptacle, the receiver block detent engaging the fastener detent when the cam lock fasteners are placed into engagement with the slotted opening of a corresponding receiver block.

* * * * *